United States Patent [19]

Miyashita et al.

[11] 4,408,756

[45] Oct. 11, 1983

[54] COLLATOR WITH COLLATE MODE AND JOB SEPARATION MODE

[75] Inventors: Kiyoshi Miyashita; Muneo Kasuga; Akira Shimizu, all of Hachioji; Fumitaka Ozeki, Inagi; Hiroshi Tsuda, Mitaka; Katsuhiko Kimura, Hino; Nobuoto Hattori, Hachioji; Norio Amemiya, Hachioji; Masaru Yamazaki, Hachioji, all of Japan

[73] Assignee: Olympus Optical Company Limited, Tokyo, Japan

[21] Appl. No.: 288,376

[22] Filed: Jul. 30, 1981

[30] Foreign Application Priority Data

Jul. 31, 1980 [JP] Japan ..... 55-105440

[51] Int. Cl.[3] ..... B65H 39/10

[52] U.S. Cl. ..... 271/288; 271/296

[58] Field of Search ..... 171/287, 288, 289, 290, 171/296, 298, 303

[56] References Cited

U.S. PATENT DOCUMENTS 3,848,867 11/1974 Johnson ..... 271/296 X 4,114,871 9/1978 Botte ..... 271/296 X

*Primary Examiner*—Richard A. Schacher

*Attorney, Agent, or Firm*—Fleit, Jacobson & Cohn

[57] ABSTRACT

A collator includes a series of twenty bins arranged in parallel with each other, a copy feeding member for feeding copies supplied from a copying machine along inlets of the successive bins, first and second deflecting devices arranged at the uppermost two bins for delivering the copies into the uppermost two bins and a distributor movable between the third bin and the twentieth bin for delivering the copies into the bins. The collator can treat the copies in a job separation mode in which all copies of each documents are delivered into respective bins in succession, while the distributor is advanced bin by bin in response to a distributor advance signal produced by a variable timer which is actuated upon detection of the rear edge of the last copy of an Nth original by an entrance switch to set a time period represented by $b+(N-1)\times a/V_1$, wherein a is a pitch between successive bins, b is a distance from the entrance switch to the first bin and $V_1$ is a copy feed speed in the collator.

6 Claims, 24 Drawing Figures

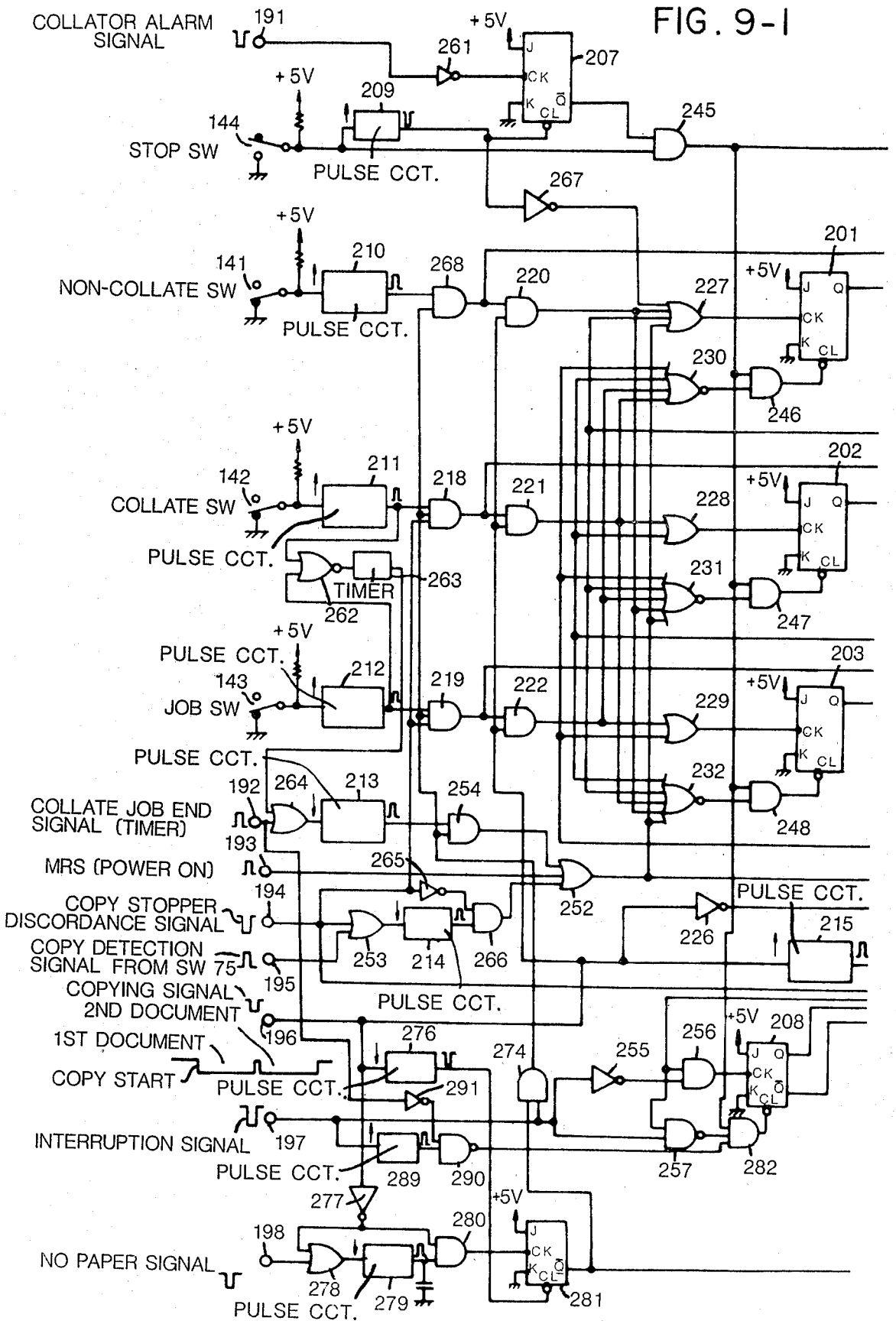
FIG. 9-1
COLLATOR ALARM SIGNAL
191
+5V
261
207
J
CK
K
CL
Q̄
+5V
209
144
STOP SW
PULSE CCT.
245
267
+5V
201
141
210
268
220
+5V
NON-COLLATE SW
227
PULSE CCT.
230
246
+5V
202
142
211
218
221
+5V
COLLATE SW
228
PULSE CCT.
263
TIMER
262
231
247
+5V
PULSE CCT.
203
143
212
219
222
+5V
JOB SW
229
PULSE CCT.
232
192
264
213
254
248
COLLATE JOB END SIGNAL (TIMER)
193
MRS (POWER ON)
265
194
252
PULSE CCT.
COPY STOPPER DISCORDANCE SIGNAL
226
215
COPY DETECTION SIGNAL FROM SW 75
253
214
266
195
COPYING SIGNAL
2ND DOCUMENT
PULSE CCT.
196
+5V
208
1ST DOCUMENT
276
274
255
256
COPY START
PULSE CCT.
291
INTERRUPTION SIGNAL
197
PULSE CCT.
289
290
257
282
277
+5V
198
280
NO PAPER SIGNAL
278
279
281
PULSE CCT.

COLLATOR WITH COLLATE MODE AND JOB SEPARATION MODE

BACKGROUND OF THE INVENTION

The present invention relates to a collator for use in combination with an apparatus such as a copying machine, a printing machine and the like which discharges copies of original in succession.

Such a collator is often used in combination with an electrophotographic copying machine and successive copies of an original supplied from the machine are delivered into respective bins or compartments in a correct order. This mode of operation is referred to as the "collate mode" hereinafter. Such a collator can be roughly classified into three types depending on the manner of delivering the copies into the bins. In a first type, a number of bins are fixedly arranged and a distributor comprising a deflector and a copy feed mechanism is moved along a series of bins. In a second type, a series of bins are moved with respect to a copy supply position fixedly arranged in the collator. In a third type, a series of bins are fixedly arranged and at an inlet of each bin is arranged a claw like deflector. This third type of collator can be further classified into two groups. In a first group, each deflector is driven by a respective solenoid, and in a second group, each deflector is successively driven by an actuating member movable along the series of bins.

The first type of collator is of simple construction and can be easily produced. In the second type of collator, since the heavy bins must be driven, the collator can not be combined with a high speed copying machine, and requires a large space. In the first group of the third type collator, since the deflectors can be driven separately from each other, the collator can be advantageously combined with a high speed copying machine. However, each deflector has to be provided with a solenoid and a copy feed mechanism and thus, the construction is liable to be complicated and expensive. In addition control of the various parts is liable to be complex. In the second group of the third type of collator, although it is not necessary to provide a solenoid for driving deflectors, the copy feed mechanism should be provided at respective bin positions.

In the first type of collator, the distributor is returned to an initial position after the collating operation for the last copy of a certain original has been finished, but prior to the arrival of the first copy of the next original at the collator. Hereinafter, the initial position is called the "home-position". In Japanese Utility Model Application Publication No. 47,956/78, there is disclosed such a collator, in which a number of bins are arranged vertically one above the other, and a distributor is movable from the uppermost bin to the lowermost bin so as to deliver each copy of an original into a respective bin. In this collator, the distributor is returned to the home-position upon actuation of a print start switch of on the copying machine. Further Japanese Patent Application Publication No. 8,665/76 discloses a similar collator in which a distributor is returned to the home-position after a time period J has elapsed after initial detection of a copy. The period J is defined by $T>J>t$, wherein t is a time interval between successive copies of the same original and T is a time interval between the last copy of a certain original and the first copy of the next document. These collators can be effectively used in combination with commonly available copying machines in which a single exposure of an original can form a single copy and multiple copies of the original are obtained only by means of multiple exposures of the same original; thus, there is a substantial time for removing the first original and setting the next original, and said time interval T is long.

Japanese Patent Laid-Open Publication No. 12,986/80 discloses a retention type of copying machine in which a plurality of copies of an original can be obtained from the same and single electrostatic charge image once formed by subjecting it to development and transfer repeatedly. In such a copying machine of the retention type, the exposure and scanning of the second document can be initiated before a completion of a duplicating operation for the first document and thus, the time interval T from the last copy of a document to the first copy of the next document can be materially shortened and, in an extreme case, can be made identical with the time interval between successive copies of the same document. When adapting the known collators described in the above mentioned publications Nos. 8,665/75 and 47,956/78 to the retention type copying machine, it is necessary to return the distributor to the home-position during the short time interval T. However, this is very difficult. In an extreme case, if a large number of copies are to be formed, the first copy of the second document might arrive at the first bin corresponding to the home-position before the last copy of the first document has been completely delivered to the bin. In such a case, the above mentioned collators could never be used.

In order to solve the above problem, it has been further proposed to drive the distributor in a reciprocating manner. Then, however, the controlling of the distributor is liable to be difficult. Further this collator could not be used where the number of copies for successive originals are different from each other.

Various collators which could be combined with the copying machine of retention type have been proposed. For instance in one proposed collator, a number of bins are arranged vertically and successive copies are fed along the bins downward and are delivered into the bins from the lowermost bin. That is to say, the copy feed direction is made opposite to the collating direction. In such a collator, the distributor is returned to the lowermost bin at the home-position after the last copy of a document has been completely delivered into a bin, and thus, if the returning speed of the distributor is made at least equal to the copy feeding speed, the first copy of the next document can be correctly delivered into the lowermost bin. However, in such a collator, since the home-position is set at the lowermost bin and the copies are successively collated toward the upper bins, it is very inconvenient for the operator to take the collated copies out of the bins, especially when the number of copies to be formed for respective originals is relatively small. In order to avoid such a drawback, it has also been proposed to feed the copies in a direction from the lowermost bin to the uppermost bin so that the copies are successively delivered into the bins from the uppermost one. In such a collator, the operator can easily take out the collated copies, because the home-position is set at the uppermost bin and copies are successively delivered downward from the uppermost bin. However, usually the copying machine has its copy outlet at a relatively high position and thus, the collator should be provided with a copy feed mechanism for feeding the copy supplied from the copying machine to the lowermost bin. Therefore, the copy feed mechanism is liable to be large in size and complicated in construction. Further, since the copy has to travel a very long and complicated path, there might occur paper jamming.

Some collators have another function referred to as "job separation mode" or "job mode", in which all copies of respective originals are delivered into each of successive bins. In this job mode of operation, it is important that the distributor be advanced by one bin pitch. That is to say, after the last copy of a document has been completely delivered into a bin, the distributor should be advanced into next bin.

It is convenient to provide a copy detecting member at the inlet of the collator. In this way, the distributor advance timing can be set by means a copy detection signal supplied from the detecting means. However, since distances from the copy detecting means to respective bins are different from each other, it is impossible to set fixedly the distributor advance timings. This difficulty can be removed by providing a number of timers having different set times each corresponding to respective bins. However, such a solution is not preferable, because the number of timers is large and circuits related thereto are also complicated.

SUMMARY OF THE INVENTION

The present invention has for its object to provide a simple and less expensive collator in which the distributor advancing timings can be obtained by means of a single timer.

According to the invention, there is provided a collator for use in combination with an apparatus such as a copying machine, a printing machine and the like which discharges a plurality of copies of originals in succession. The collator includes a series of bins arranged in parallel with each other at a constant pitch. A device feeds the copies through a copy feed path along the series of bins at a constant speed. A distributor moves along the copy feed path across a predetermined number of bins to deliver the copies into the predetermined number of bins. Apparatus, responsive to actuation of an operator, sets the collator in a collate mode in which a plurality of copies of respective originals are delivered into successive bins. Additional apparatus responsive to actuation of the operator, sets the collator in a job separation mode in which all copies of each of successive originals are delivered into respective bins in succession. A time pulse generator generates a timing signal for moving the distributor in the job separation mode.

The time pulse generator includes a counting device for accumulating a signal supplied from the copy discharging apparatus to produce a count value N, said signal representing the number of said originals. A detecting device is arranged at an inlet portion of the collator for detecting a rear edge of the respective copies to produce a copy detection signal. A variable timer sets, in response to the copy detection signal supplied from the copy detecting device upon detection of the rear edge of the last copy, of an Nth original, a set time represented by $b+(N-1)\times a/V_1$, wherein a is the constant pitch of the series of bins, b is a distance from the copy detecting device to the first bin viewed in a copy feed direction and $V_1$ is the constant copy feeding speed, the timing signal which defines the timing for advancing the distributor bin by bin being produced at a completion of the set time.

DETAILED DESCRIPTION OF THE PREFERRED EMBODIMENTS

Figure 1:
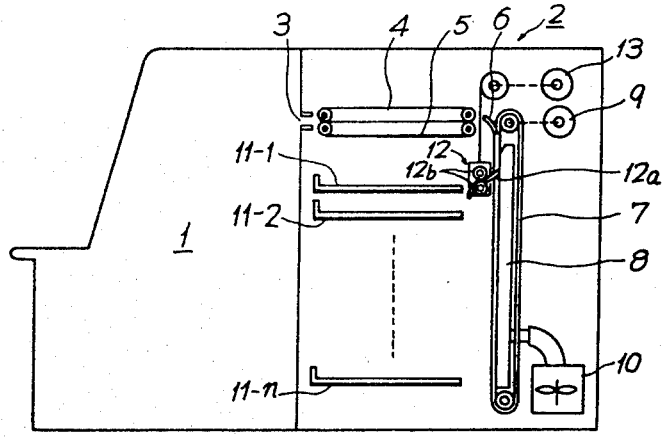
FIG. 1 is a cross-sectional view showing an embodiment of a known collator comprising a movable distributor.

FIG. 1 is a schematic view showing the former type of the known collator in which the above mentioned distributor is moved. A copy formed by a copying machine 1 is transported into a collator 2 through an inlet 3 and is fed between a pair of travelling belts 4 and 5. Then the copy is urged against a deflection plate 6 and is deflected downward, and is finally sent downward by a travelling belt 7 and a suction box 8. The travelling belt 7 is driven by a motor 9, and the suction box 8 is connected to a suction fan 10. A plurality of shelves (hereinafter referred to as bins) 11-1 to 11-n for accommodating the copies are arranged horizontally in parallel with each other. The bins are spaced perpendicularly from each other. In a space between a copy feed path defined by the travelling belt 7 and the suction box 8, and inlets of the bins 11-1 to 11-n, is arranged a distributor 12 which is movable along the copy feed path. The distributor 12 can be moved up and down by means of a motor 13. Also the distributor 12 comprises a claw 12*a* for deflecting the copy from the feed path and a pair of feed rollers 12*b* which supply the copy deflected by said claw into a given bin.

As shown in FIG. 1 when the distributor 12 is at a home-position, it can supply the copy into the uppermost bin 11-1, and the collating operation is always made downward from the said home-position. Since use is made of the single common distributor 12 for all the bins 11-1 to 11-n, the collator can be manufactured in a very simple and inexpensive manner with the controlling method being likewise simple. But after collating the final copy of a certain document, the distributor 12 must be returned to said home-position in order to feed the first copy of the next document into the uppermost bin 11-1. In the known collator, the return of this distributor 12 can be effected during a relatively long time interval during which an operator changes the relevant document for a next document. Accordingly, the known collator with the moving distributor is designed on the basis of the fact that there is always a long time interval between the final copy of a certain document and the first copy of the next one. Therefore, this type of collator cannot be combined with the retention type copying machine which does not have a long time interval. That is to say, in the usual type of the copying machine, the second document can be set only after the scanning of the first document is producing its final copy has been completed. On the other hand, in the retention type copying machine, the second document can be set before the end of the final copy of the first one. Therefore in such a retention type copying machine, the time interval between the final copy of the first document and the first copy of the next one can be made identical with an interval of the successive copies of the same document. In this case, during delivery of the final copy of the first document into the lowermost bin 11-n, the first copy of the next one might be discharged from the copying machine 1 and reach the position of the first bin 11-1. Therefore, the collating action could not follow the successively supplied copies because of the short interval between the last copy of the first document and the first copy of the next document.

Figure 2:
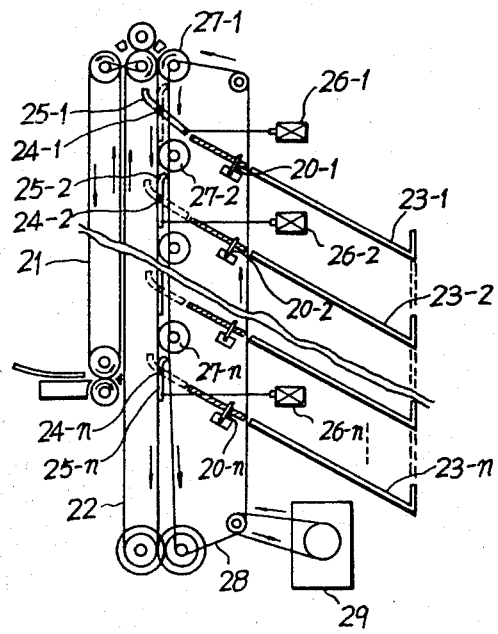
FIG. 2 is a cross-sectional view showing one embodiment of a known collator comprising deflection devices provided at respective bins.

FIG. 2 illustrates another known collator comprising deflection claws at copy inlets of respective bins. The claws are selectively driven to collate copies. A copy sent from a copying machine (not shown) is held between a pair of feeding belts 21 and 22, sent upwards, deflected at the top position, and then fed downward. At the inlets of the respective bins 23-1 to 23-n, the deflection claws 25-1 to 25-n are arranged movably about the shafts 24-1 to 24-n and these deflection claws are connected to solenoids 26-1 to 26-n. At the inlets of the respectie bins 23-1 to 23-n are also arranged feeding rollers 27-1 to 27-n, which are rotated by means of a belt 28 and a motor 29. When the first copy of a certain document is supplied, the deflection claw 25-1 is rotated by means of the solenoid 26-1 as illustrated in FIG. 2 and the pointed end of the deflection claw is introduced into the travelling path of the copy. The copy fed between the travelling belt 21 and the feeding roller 27-1 is deflected by the deflection claw 25-1, and then is delivered into the uppermost bin 23-1. When a microswitch 20-1 arranged in this bin detects the copy, the solenoid 26-1 is de-energized and then the deflection claw 25-1 is removed from the copy feed path. At the same time the solenoid 26-2 is energized to move the deflection claw 25-2 into the copy feed path and a next copy can be delivered into a next bin 23-2. In this manner successive copies can be delivered into the successive bins. In such a collator even if the last copy of the first document and the first copy of the next document are supplied within a short time interval, they can be correctly collated. However, such a collator comprises a number of elements such as the deflecting claws 25-1 to 25-n arranged movably at the respective bins 23-1 to 23-n, the solenoids 26-1 to 26-n for moving these deflection claws, and the feeding rollers 27-1 to 27-n and thus is complicated in construction and very expensive, especially if the number of bins increases. Moreover, it has been reported that if the copying speed reaches about 70 sheets per minute, it is impossible to drive the deflection claws, by means of the solenoids having low response and reliability, and more expensive stepping motors have to be used.

In an embodiment of the collator according to the invention which will be explained later, in order to take advantage of the moving distributor type collator and the driving deflection claw type collator mentioned above, and further to overcome the various defects of these collators, at least one upstream bin is provided with the deflection claw and the other bins use a common distributor.

Figure 3A:
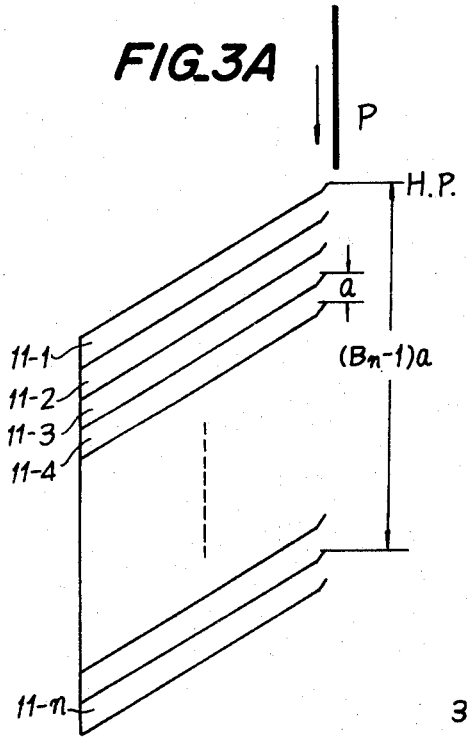
FIG. 3A is a diagram showing the collator action of the known distributor moving type.

Now the operational principle of the collator according to the invention will be explained. FIG. 3A shows the collating operation of the usual collator with the movable distributor shown in FIG. 1. Copies P of a document are fed from the upper side as indicated by an arrow and are delivered into the bins 11-1, 11-2, . . . , 11-n successively. If the interval between successive bins is a and the number of the bins is $B_n$, in order to deliver $B_n$ copies into respective bins from the uppermost bin 11-1 to the lowermost bin 11-n, the distributor must be moved downward by a distance of $(B_n-1)a$. Therefore, in order to correctly collate the first copy of the next document, the distributor must move by at most the same distance $(B_n-1)a$ to return to the home position H.P.

Figure 3B:
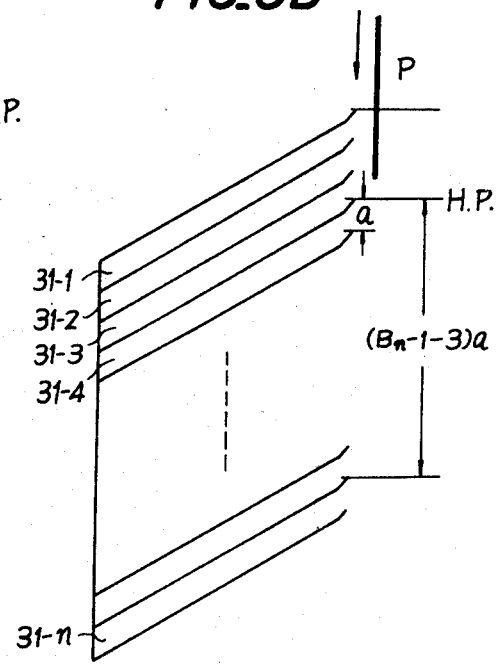
FIG. 3B is a diagram explaining an operational principle of a collator according to the invention.
Figure 3C:
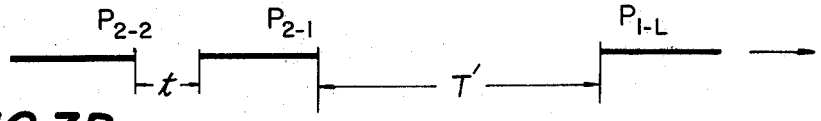
FIG. 3C is a diagram showing a manner of supply of successive copies in a copying machine of single exposure-single copy type.
Figure 3D:
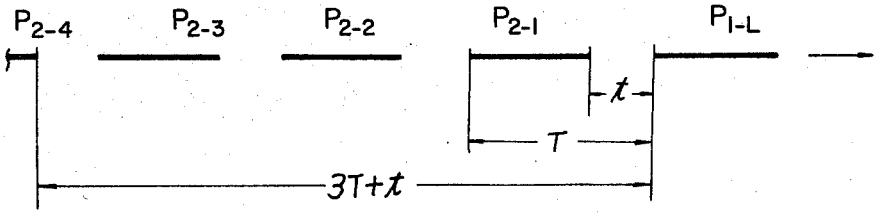
FIG. 3D is a diagram showing a copy supply of a retention type copying machine.

FIG. 3C shows the interval of the successive copies fed from the usual copying machine of single exposure-single copy type. The time interval from the rear edge of the final copy $P_{1-l}$ of the first document to the front edge of the first copy $P_{2-1}$ of the second one is generally indefinite because the document is exchanged by an operator during this interval, but there is the shortest time interval T'. While a time interval t of the successive copies $P_{2-1}$, $P_{2-2}$, . . . of the same document is almost definite. When the successive copies are fed in the manner shown in FIG. 3C, the distributor can move by the distance $(B_n-1)a$ and can return to the home-position H.P. during the time interval T'. However in the retention type copying machine, a time interval t of the successive copies is, as shown in FIG. 3D, always definite. In order to collate the maximum number Bn of the longest copies, the interval t must be made sufficiently long and the distributor must return to the home-position H.P. at a very high speed, because in this case the distributor has to move from a time constant at which the first document $P_{1-l}$ has delivered into the lowermost bin 11-n and has to arrive at the home-position before the first copy of the second document $P_{2-1}$ reaches the home-position H.P. However, if the time interval t is made longer, the feeding interval T of the successive copies has also to be longer and thus, the copying speed of the copying machine is limited. One of the merits of the retention type copying machine is the high copying speed. Thus, it is not desirable to lose this ability when the copier is combined with the collator. Moreover, it is practically impossible to make the returning speed of the distributor faster. In an example of the retention type copying machine, the copy feeding pitch T is 6 seconds (10 copies/min.) and in the time interval t of the longest copies is 0.675 sec. Besides, the copy travelling speed is 66.7 mm/sec. and so the time interval t of 0.675 sec. corresponds to a distance of about 45 mm. Therefore, in order to combine the collator of the distributor moving type with such a copying machine, all the bins must be arranged within this distance 45 mm, even if the time necessary for returning the distributor to the home-position is ignored. But, in practice, such a construction is not practical. In order to overcome such a problem it also has been suggested that the travelling speed of the copy in the collator be made higher than the copy discharging speed from the copying machine. But in such a construction, the travelling mechanism is liable to be large and expensive, and also a mechanism for stopping the distributor at given positions must be of high precision and is likely to be expensive. Moreover, in such a construction, a buffer portion should be provided between the outlet of the copy from the copying machine itself and the inlet of the travelling mechanism of the collator and the length of this buffer portion should be longer than that of the longest copy, and thus the collator is liable to become large in size and a freedom of design might be limited.

FIG. 3B is a diagram showing an operation principle of the collator according to the invention. The number Bn of the bins 31-1 to 31-n and the interval a of the bins are the same as shown in FIG. 3A. Now, it is assumed, for the convenience of the explanation, that at the uppermost three bins 31-1 to 31-3, the copies P are collated by means of respective deflection members, but at the remaining bins 31-4 to 31-n, the copies are collated by means of a single movable distributor. In such a construction, it is sufficient for the distributor to move the distance $(B_n-1-3)a$. Now, in case of collating the maximum number of the longest copies, if the returning operation of the distributor is initiated immediately after the final copy of the first document $P_{1-l}$ has been delivered into the lowermost bin 31-n, an extremely long marginal time for returning the distributor can be obtained, because the first three copies of the next document can be delivered into the uppermost three bins 31-1 to 31-3 by means of the respective deflection members and thus, it is sufficient for the distributor to return to the inlet position of the fourth bin 31-4 until a time instant at which the front edge of a fourth copy has reached the inlet of the fourth bin 31-4, that is, during the time interval (3T+t). The position of the inlet of the fourth bin 31-4 is called hereinafter as the home-position H.P. However, it is to be understood that this is not the one for the whole collator, but the one for the distributor. As explained above, the returning time of the distributor can take at least 18 seconds if the feeding interval of the successive copies T is 6 seconds.

As mentioned previously, the deflection member is complicated in its construction as compared with the distributor and is expensive, so it is preferable to make the number of the deflection members as small as possible. Next a manner of determining the minimum number of the deflection members m while taking into account the various parameters will be explained. These parameters are as follows;

$B_n$: the total number of the bins,
a: the interval of the successive bins,
T: the feeding pitch of the successive copies,
t: the time interval of the successive copies in case of using the longest copy paper,
$V_1$: the travelling speed of the copy in the collator,
$V_2$: the returning speed of the distributor.

According to the invention, the moving length of the distributor is the distance from the home-position H.P. to the final bin 31-n, that is, $(B_n-1-m)a$. Therefore, a time period from a time instant at which the rear edge of the final copy of the first document has passed through the home-position H.P. to a time instant at which the rear edge of the final copy has passed through the inlet of the final bin 31-n, is given by $(B_n-1-m)a/V_1$. On the other hand, the time necessary for the distributor to return from the final bin 31-n to the home-position H.P. is given by $(B_n-1-m)a/V_2$. When m deflection members are arranged from the uppermost bin 31-1 to the mth bin 31-m, the marginal time is given by mT+t. Therefore, it is necessary to select the various parameters so as to satisfy the following relation:

$$mT + t \geqq \frac{(B_n - 1 - m)a}{V_1} + \frac{(B_n - 1 - m)a}{V_2}$$

It should be noted that since the number of bins m has to be naturally an integral number, it is possible to attain the advantage to the best extent by selecting the smallest integral number m while satisfying the above mentioned inequality. Nevertheless, in this invention the number m is not limited to the smallest number, but it is possible to arrange more than m deflection members.

For instance, assuming that the number $B_n$ of bins in the collator is 20, the spacing of the bins a is 25 mm, the feeding pitch T is 6 sec., the interval t of the longest copies is 0.67 sec., the travelling speed in collator $V_1$ is 66.7 mm/sec. which is same as the travelling speed in copying machine, and the returning speed of the distributor $V_2$ is 133.4 mm/sec. which is twice as fast as the copy travelling speed, the solution of the above inequality results in $m \geqq 1.52$. Accordingly, $m=2$ as the least integral number satisfying the inequality can be selected. Therefore, from the above assumptions it is preferable that the deflection members are arranged only for the two uppermost bins, and for the other 18 bins the collate action is performed by moving the distributor. In such a preferable embodiment according to this invention, even if the number of the deflection members is decreased, the collating operation can be completely accomplished and the complication of construction and price of the collator can be limited to a great extent.

Figure 4:
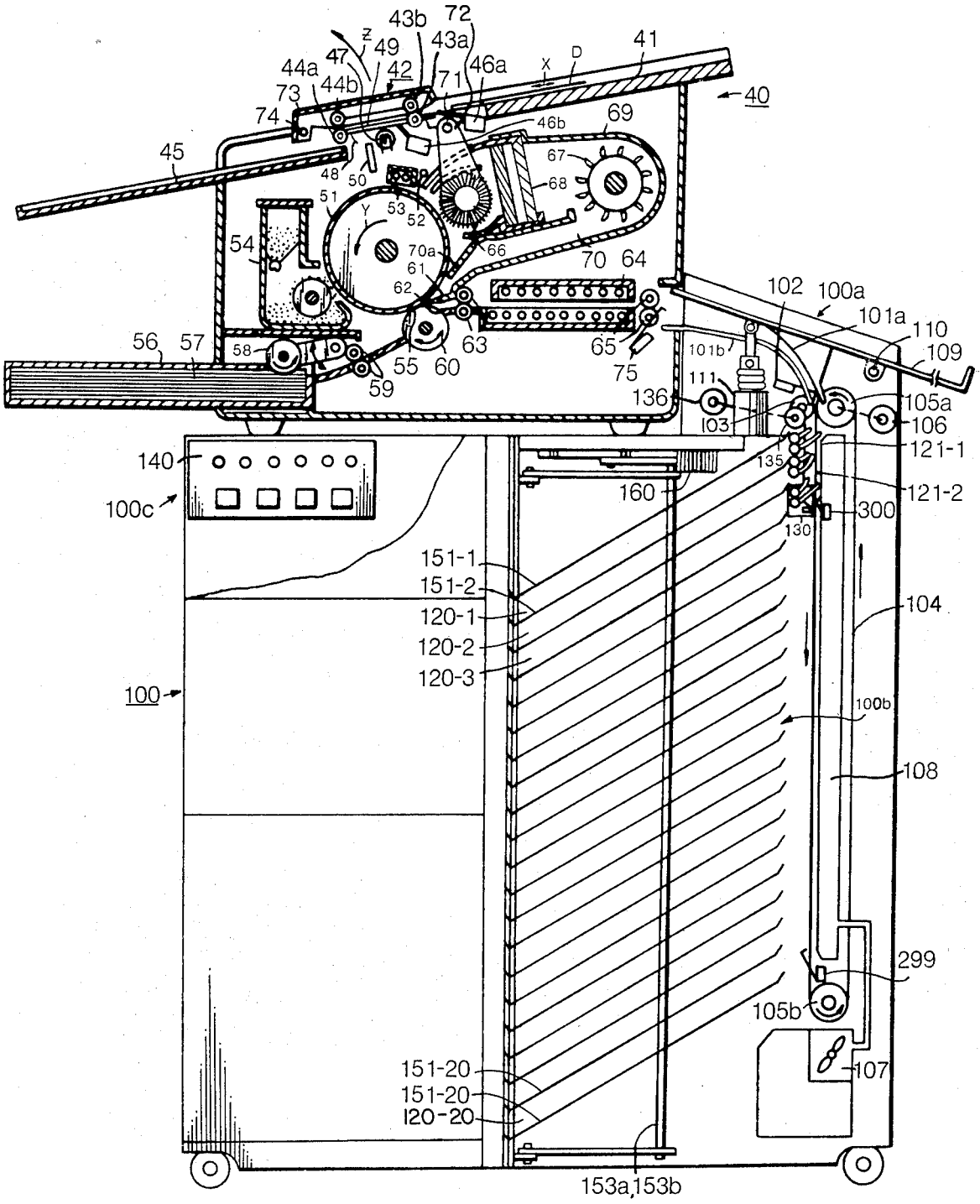
FIG. 4 is a diagram showing an embodiment of a collator according to this invention combined with a retention type copying machine.

FIG. 4 is a schematic sectional view showing an embodiment of the collator according to the invention in combination with a copying machine. A copying machine 40 for this embodiment is of the retention type and a plurality of copies of a document are formed from the same and single electrostatic charge image. A reference numeral 100 denotes generally the collator in which two deflection members are provided for two uppermost bins and a distributor is provided for the remaining bins. The copying machine is placed on a table of the collator.

In FIG. 4 a sheet-like original D to be copied is placed on an inclined original table 41 and moved into an original feeder 42 in a direction shown by an arrow X. Feeding rollers 43*a* and 43*b* of the original feeder 42 feed the original D toward an original tray 45 while causing the original to pass through a transparent glass plate 49 above an illuminating lump 47, a reflection mirror 48 and an optical system 50. The optical system 50 projects an image of the illuminated original 1 onto a rotary photosensitive drum 51. The photosensitive drum 51 has a photoconductive layer, which for instance consists of selenium (Se), and rotates in a direction shown by an arrow Y. After removing charge by a charge removing lamp 52, the photoconductive layer is uniformly charged by a corona discharge device 53, so that upon projection of the aforesaid image of the original, an electrostatic latent image is formed on the photoconductive layer. This latent image is developed by a development device 54 which makes use of a dry two component developing agent, and then the developed image is forwarded to a toner-transfer station 55 as the photosensitive drum 51 rotates.

On the other hand, a recording paper cassette 56 carries plural sheets of recording paper 57, and a rotary pickup roller 58 journaled to a swingable arm picks up the recording paper, one sheet at a time, so as to feed the recording paper to the toner-transfer station 55 at predetermined timing under the control of register rollers 59. The toner-transfer station 55 has a biased transfer roller 60. The recording paper 57 passes between the photosensitive drum 51 and the transfer roller 60 so as to overlay the toner image onto the recording paper to transfer the toner image thereon. During this process, the recording paper moves together with the toner image; i.e., in tight contact with the surface of the photosensitive drum, until separating pawls 61 separate the recording paper from the drum in cooperation with an air flow to be described hereinafter. A guide 62 directs the recording paper to feeding rollers 63 which feed the recording paper to a thermal fixing device 64 having a heater for fixing the toner image. Discharge rollers 65 discharge the recording paper with the fixed toner image out of the copying machine 40. Since the toner image on the photosensitive drum 51 is not completely transferred to the recording paper 57 and partially remains on the drum, a rotary cleaner brush 66 brushes off residual toners from the photosensitive drum after the toner image passes through the toner-transfer station. A fan 67 generates an air flow to suck the brushed off toners, and a filter 68 collects the toner particles from the air flow. A housing 69 encloses the cleaner brush 66 and the fan 67 to produce an effective suction for sucking the toner and to prevent the toner particles from being scattered in the apparatus. The exhaust from the fan 67 is guided by a duct 70 having an outlet facing the toner-transfer station 55, so that the exhaust air flow from the outlet of the duct 70*a* coacts with the separating pawls 61 in separating the recording paper 57 from the photosensitive drum 51 in a reliable fashion.

A support pin 71 swingably carries one end of an arm 72, and the opposite end of the arm rotatably holds the rotary cleaner brush 66. The cleaner brush 66 is kept away from the photosensitive drum 51 when the electrostatic latent image once formed on the photosensitive drum is repeatedly subjected to development and transferring for forming a plurality of copies of one original in the retentive manner. A trimming lamp is provided to face the photosensitive drum 51 in the proximity thereof at a position between the image projecting optical system 50 and the developing device 54, so as to remove the electric charge from blind areas or those areas of the photosensitive drum which do not intend to transfer any image to the recording paper. Switches 46*a* and 46*b* detect the positions of each original D in the electrophotographic apparatus, so as to sequentially control the aforementioned constitutional parts of the apparatus. Further, at the copy discharging outlet of the copying machine 40 is arranged a copy detection switch 75. In case of copying a thick manuscript such as a book, a cover 73 of the document feed device 42 is turned about a shaft 74 in a direction shown by an arrow Z so as to form a planer document feed path for a transparent book carrier on which the book to be duplicated is placed.

In the next place, the collator 100 will be explained in detail. The collator 100 is mainly composed of a sheet delivering unit 100*a*, a bin unit 100*b*, and an operation unit 100*c*. The sheet delivering unit 100*a* comprises guide plates 101*a*, 101*b* which deflect the proceeding direction of the sheet-like copy sent from the copying machine 40 almost downward, and a copy detection micro-switch 102 having an actuator provided near an outlet of the guide plates. In order to feed the copy almost perpendicularly from the upper position to the lower one, a feed roller 103 and a plurality of conveyor belts 104 are arranged below the guide plate outlet. The conveyor belts 104 are wound between a pair of rollers 105*a*, 105*b* rotatably in a direction shown by arrows. The roller 105*a* is rotated by means of a motor 106. In a space surrounded by the belts 104 is arranged a suction box 108 connected to a suction fan 107. The conveyor belts 104 have many suction holes formed therein and a copy fed from the guide plates 101*a*, 101*b* is held on the conveyor belts by a suction force produced by the suction fan 107. Further in this embodiment, the feeding speed of the copy supplied from the copying machine 40 is almost the same as that of the copy feeding speed by means of the conveyor belts 104. Moreover, a distance between the paper discharging roller 65 of the copying machine 40 and an inlet of the copy travelling portion in the collator 100, that is nip point of the travelling roller 103 and the belts 104, is made shorter than the length of the shortest copy sheet.

Figure 5:
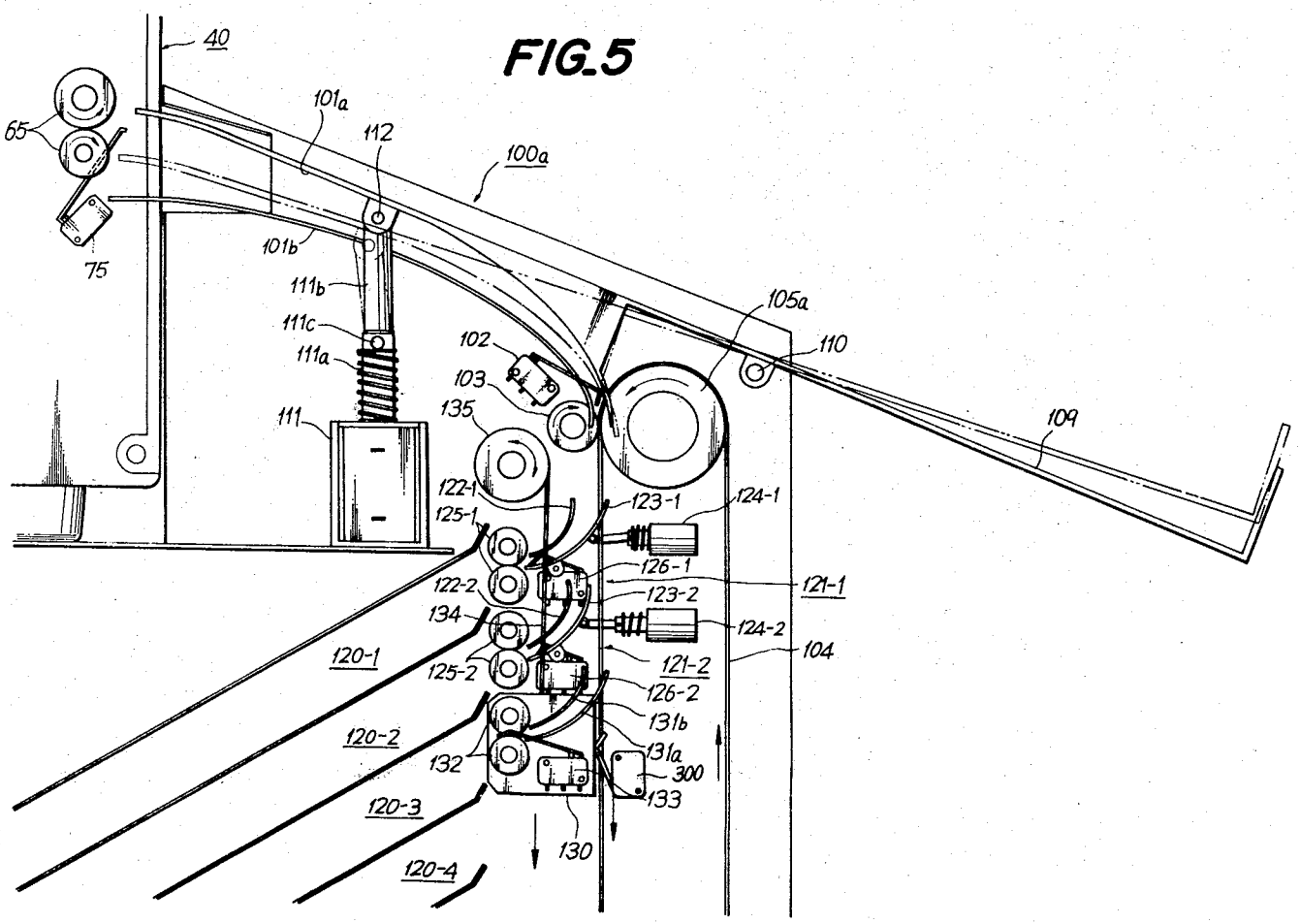
FIG. 5 is an enlarged cross-sectional view showing a detailed construction of a part of the collator shown in FIG. 4.

In the present embodiment, an upper side of the one guide plate 101*a* forms a part of an extra copy tray 109. Therefore, this guide plate 101*a* is journaled to a shaft 110 and is connected to a solenoid 111. Thus upon energizing the solenoid, the guide plate 101*a* is tilted as illustrated in FIG. 5 by a dot line. To this end a plunger 111*a* of the solenoid 111 is connected to an arm 111*b* which is rotatably secured to a shaft 111*c* fixedly arranged on the guide plate 101*a*. As will be explained later in detail, when a non-collate mode is selected, copies supplied from the copying machine 40 are discharged on the extra tray 109 by energizing the solenoid 111.

The copying machine 40 according to this embodiment can duplicate twenty sheets of copies from the single latent image and thus, the bin unit 100*b* of the collator 100 comprises twenty bins 120-1 to 120-20 arranged vertically at the same interval. Therefore, successive copies discharged from the guide plates 101*a*, 101*b* are travelled vertically along the copy inlets of each bins by the conveyor belt 104. In order to deliver the copies fed successively from upper side to lower one into a plurality of bins of the bin unit 100*b*, deflection members and a distributor are arranged in the space between the conveyor belts 104 and the bin unit 100*b*. In this embodiment, the deflection members 121-1 and 121-2 are provided at the upper two bins 120-1 and 120-2, respectively viewed in the copy travelling direction, and for the remaining 18 bins 120-3 to 120-20 the distributor 130 which moves vertically between this interval of the bins is arranged. As shown distinctly in FIG. 5, each deflection members 121-1 and 121-2 comprise fixed guides 122-1, 122-2, deflection claws 123-1, 123-2 arranged rotatably, solenoids 124-1, 124-2 which rotate said deflection claws, a pair of feed rollers 125-1, 125-2 which feed copies into bins, and micro-switches 126-1, 126-2 which detect the copies. In the state shown in FIG. 5, the deflection member 121-1 for the first bin 120-1 is prepared for collating a first copy, and the deflection claw 123-1 is rotated in the clockwise direction by energizing the solenoid 124-1, so that a tip of the deflection claw intrudes into the copy travelling path composed by the belts 104. Therefore, if the first copy is traveling from the upper side, a tip of the copy contacts the deflection claw 123-1 and is deflected to the left direction, travels between the guide 122-1 and the deflection claw 123-1, and further fed by the pair of feed rollers 125-1 into the first bin 120-1. In FIG. 5, only one deflection claw 123-1 is shown, but in fact, a few deflection claws are arranged coaxially about a shaft extending perpendicularly to the plane of the drawing and each of the deflection claws intrudes in spaces between the successive belts 104. Moreover, the microswitches 126-1, 126-2 provided in the deflection members 121-1, 121-2 usually detect the passage of the copy, but in this embodiment, the stop of a copy paper, that is a paper jam, is also detected by the signal from the microswitches as will be mentioned later.

The distributor 130 comprises a pair of the deflection claws 131*a*, 131*b*, a pair of feed rollers 132, and a microswitch 133. A motor (not shown) which rotates these feed rollers 132 is disposed on the distributor 130. Moreover, in order to move the distributor 130 in a reciprocating manner between the third bin 120-3 and the 20th bin 120-20, there is provided a wire 134 having one end fixed to the distributor 130 and the other end wound around a pulley 135. The pulley 135 is connected to a distributor driving motor 136 (FIG. 4). Upon driving the motor 136 in the positive direction, the wire 134 is unwound from the pulley 135 and the distributor 130 moves downward, and in driving the motor 136 in the reverse direction, the pulley 135 rewinds the wire 134 and the distributor 130 can return to an upper position.

Now the operation of the collator according to this embodiment will be explained. The copying machine 40 used in combination with the collator according to this embodiment is of the retention type and in a following explanation it is assumed that the copying machine makes twenty copies for each original document. It is also assumed that the circumferential length of the photosensitive drum 51 of the copying machine 40 is 400 mm, and one copy is formed by one rotation of the drum. Moreover, the copying speed of the copying machine 40 is selected to be ten sheets per minute, and the feeding pitch T of the successive copies is six seconds. Therefore, the copy travelling speed in the copying machine 40 is 400 mm/6 seconds=66.7 mm/sec. Moreover, the longest available length of a copy is a legal size copy having the length of 355 mm. Hence, the time interval t of the successive copies is $(400-355)/66.7=0.675$ sec. Further, the time interval between the last copy of a certain manuscript and the first copy of the next document is also the same as the above mentioned time interval $t=0.675$ sec. Therefore, the copy is fed successively from the copying machine at the cycle $T=6$ sec. with the time interval $t=0.675$ sec. Meanwhile, for the collator, a copy travels at the same speed as the copy travelling speed in the copying machine 40.

First of all, when the first copy of the first manuscript is fed, the first solenoid 124-1 is energized and the deflection claw 123-1 is moved into the position as shown in FIG. 5. Accordingly, this copy is deflected by the deflection claw 123-1 and fed into the first bin 120-1 by the feed rollers 125-1. When the first copy has been supplied into the first bin 120-1, the solenoid 124-1 is de-energized and the deflection claw 123-1 is removed from the copy travelling path. Secondly, the second solenoid 124-2 is energized and the second deflection claw 123-2 is introduced into the copy travelling path. Then a next copy which is fed within the time interval of 0.675 sec. is deflected by the second deflection claw 123-2 and supplied into the second bin 120-2 by the feeding roller 125-2. After accommodation, the second solenoid 124-2 is de-energized and the deflector claw 123-2 is moved out of the copy travelling path. The third copy fed subsequently is deflected by the deflection claw 131*a* of the distributor 130 situating at the home-position H.P. and is delivered into the third bin 120-3 by the feed rollers 132. After accommodation, during the time interval 0.675 sec., the distributor driving motor 136 is energized to rotate in the positive direction and the distributor 130 is moved downward by the interval a of the successive bins. This interval a is 25 mm. Therefore, the fourth copy is supplied into the fourth bin 120-4. Every time the copy from the fifth to the 20th is fed, the above mentioned operation is repeated and these copies are classified and supplied successively into the bins from the fifth bin 120-5 to the 20th bin 120-20.

In this case, a time interval from a time instant when the front edge of final copy of the first manuscript has passed through the inlet of the first bin 120-1 to a time instant at which the first copy of the second document comes to the same position, is the same as the feeding cycle of 6 sec. Hence, when the final copy of the first manuscript moves by 400 mm downward from the above mentioned position, the first copy of the second manuscript arrives at the inlet of the first bin, so that immediately after the final copy of the first document has passed through the first deflection member 121-1, the solenoid 124-1 is energized and the deflection claw 123-1 is reintroduced into the copy travelling path. Therefore, the first copy of the second document is correctly delivered into the first bin 120-1. The final copy of the first document moves 75 mm more downward and supplied into the 20th bin 120-20 by means of the distributor 130. Since the length of the copy is 355 mm, the final copy travels the distance of 355 mm and is placed completely into the final bin 120-20. At this time, about 6.45 sec. have passed since the first copy of the second manuscript reached the inlet of the first bin 120-1. Therefore until this time, the first copy of the second document has been completely supplied into the first bin 120-1, and the first solenoid 124-1 is de-energized and also the second solenoid 124-2 is energized. After 6.45 sec. have passed, the second copy of the second manuscript already has been introduced into the second bin 120-2 by 5 mm from the inlet thereof. In this manner the second copy is supplied into the second bin 120-2. As mentioned above, the distributor 130 can return to the home-position after the final copy of the first document has been supplied into the 20th bin 120-20 and a returning distance of the distributor is not $19\times25=575$ mm, but only $17\times25=425$ mm. Further it is sufficient for the distributor to return to the home-position at the inlet of the third bin by the time that the third copy of the second manuscript reaches the inlet of the third bin 120-3. Since it takes about 6.37 sec. from the time when the second copy of the second manuscript has reached the inlet of the second bin 120-2 to the time when the third copy of this one has reached to the inlet of the third bin 120-3, a marginal time during which the distributor 130 returns to the home-position is about 6.30 sec. ($6.37-5/66.7$). During this time interval the distributor 130 must move by 425 mm. In the present embodiment since the returning speed (133.4 mm/sec.) of the distributor 130 is twice as fast as that of the copy travelling speed, a much longer marginal time can be obtained. However, even if the returning speed of the distributor 130 is increased in this manner, the two deflection members must be arranged for the first and second bins, because otherwise this distributor could not return in time and the front edge of the third copy of the second document will have passed through the inlet of the second bin 120-2 before the distributor arrives at the second bin.

A detailed discussion of the mechanisms and controlling circuits for operating the various portions of the collator in the manner mentioned above will now be presented.

Figure 6:
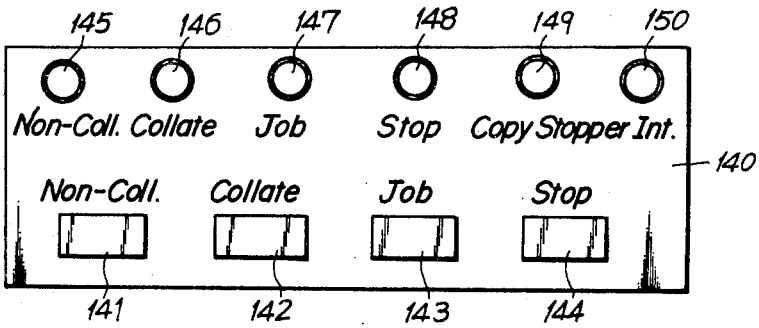
FIG. 6 is a front elevational view showing a construction of a controlling panel arranged on the collator shown in FIG. 4.

FIG. 6 is a schematic view showing a construction of a controlling panel 140 arranged in a controlling unit 100*c* of the collator 100 shown in FIG. 4. As for controlling switches, a non-collate switch 141, a collate switch 142, a job separation switch 143, and an emergency stop switch 144 are arranged, and as for indicating lamps, a non-collate lamp 145, a collate lamp 146, a job separation lamp 147, an emergency stop lamp 148, a copy stopper position discordance lamp 149, and an interruption lamp 150 are arranged.

When the non-collate switch 141 is pushed, the solenoid 111 illustrated in FIG. 5 is energized, and the guide plate 101*a* is rotated about the shaft 110, and then all the copies supplied from the copying machine 40 will be discharged on the extra tray 109.

Upon pushing the collate switch 142, the movement of the collator according to this embodiment is the same as the known collator used commonly, and successively supplied copies are classified and delivered into the successive bins.

Upon pushing the job separation switch 143 (hereinafter referred to as job switch), all the copies of the first manuscript are supplied into the first bin 120-1 and in the next place all the copies of the second document are delivered into the second bin 120-2, and followingly all the copies of the successive manuscripts are classified and supplied into the successive bins.

When the emergency stop switch 144 (hereinafter referred to as "stop switch") is actuated, the operation of the collator is stopped immediately.

Among the switches described above, the non-collate switch 141, the collate switch 142, and the job switch 143, may be momentary type switches are used, but the stop switch 144 is formed by an alternate type switch as described in detail hereinafter.

As mentioned above, in the controlling unit 100*c* according to this embodiment, the copy stopper position discordance lamp 149 is switched on when there is a difference between a position of a copy stopper and a copy size. First of all, this mechanism of the copy stopper will be explained.

Figure 7:
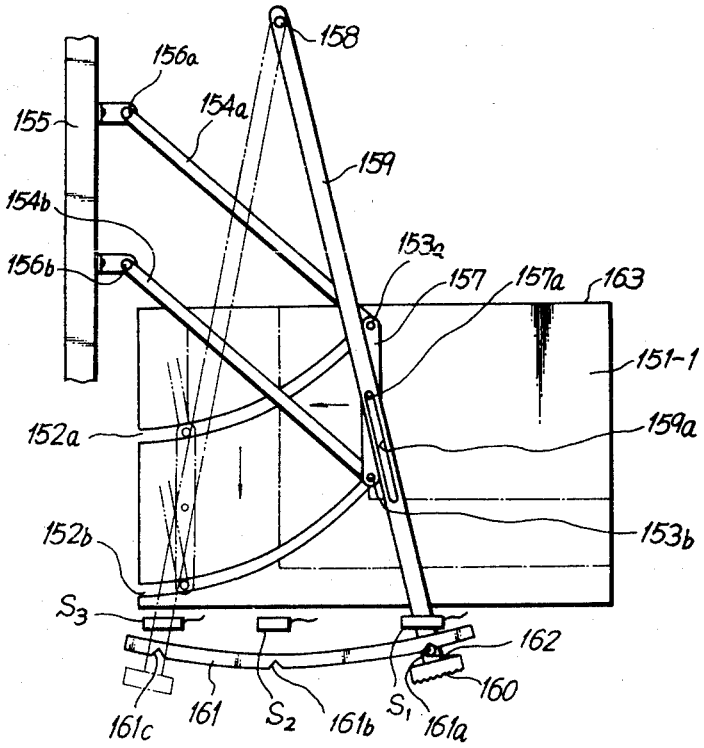
FIG. 7 is a plan view showing a construction of a copy stopper driving mechanism of the collator of FIG. 4.

FIG. 7 is a schematic view showing a construction of one embodiment of the copy stopper mechanism which is seen from an upper side of the copy accommodation bin. As illustrated in FIG. 4, the bins 120-1 to 120-2 are formed by twenty-one plates 151-1 to 151-21 which are arranged in parallel with each other, and as illustrated in FIG. 7, each of the plates has formed therein two arcuate recesses 152*a*, 152*b*. A pair of stoppers 153*a* and 153*b* are arranged to pass through these recesses, respectively. In order to form a parallel link mechanism, these stoppers 153*a* and 153*b* are rotatably journaled to one ends of link arms 154*a*, 154*b* and the other ends of these link arms are rotatably journaled to a fixed fulcrum 156*a* of a main body 150 of the collator. Further, the copy stoppers 153*a* and 153*b* are rotatably journaled to opposite ends of a connecting plate 157. In a center of this connecting plate a pin 157*a* is fixedly mounted, and this pin is arranged to pass through an elongated hole 159*a* formed in a controlling lever 159 which is in turn arranged rotatably about a shaft 158. At the free end of this controlling lever 159 is provided a controlling knob 160 comprising a click 162 which cooperates with V-shape notches 161*a*, 161*b*, 161*c* formed in an arcuate cam plate 161 for positioning the stoppers 153*a*, 153*b* at any one of three points. That is to say, the controlling lever 159 can be selectively positioned at one of the three positions defined by notches 161*a*, 161*b*, 161*c* and at these positions microswitches $S_1$, $S_2$, $S_3$ are arranged, respectively. As illustrated in FIG. 4, the parallel link mechanism is arranged at both upper and lower sides of the bin unit 100*b*, but the controlling lever 159 and the controlling knob 160 are arranged only at upper side thereof.

In the present embodiment, three kinds of copy papers such as A4, A5, and legal sizes are available, and it is possible to choose the paper size from among the three kinds by inserting the click 162 into one of the V-shape notches 161*a*, 161*b*, and 161*c*. As illustrated in FIG. 7 by a solid line, when the controlling lever 159 is located at the right hand position, the pin 157*a* is located at the uppermost end of the recess 159*a* and the copy stoppers 153*a*, 153*b* come in contact with a front edge of the A5 size copy which is the smallest size among three kinds of copies near both sides of the copy of A5 size. Here, it is assumed that all the copies are supplied into the bins along an upper edge 163 as oriented in FIG. 7. When the controlling lever 159 is moved to a the left as shown by a broken line in FIG. 7, the pin 157*a* is located at the lowermost end of the hole 159*a* and the copy stoppers come in contact with a front end of the legal size copy of the largest size mean both side edges. In this embodiment, the copy stoppers 153*a* and 153*b* are moved not only in the copy travelling direction but also in the width direction, so that copies of different sizes can be caught in the best condition and thus, there is no fear that irregularity and clog of the copies might occur.

Figure 8:
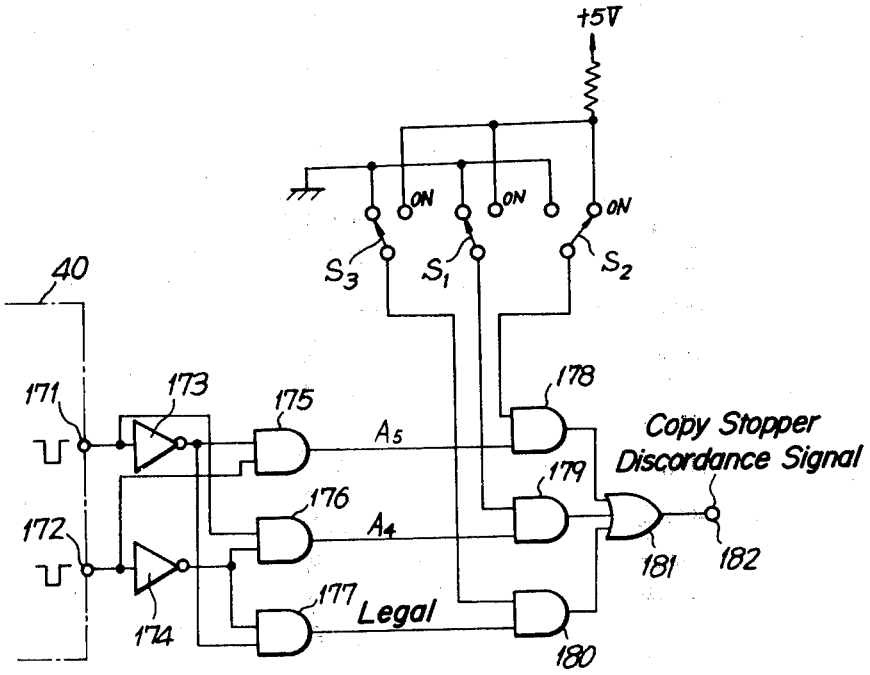
FIG. 8 is a circuit diagram showing a construction of a circuit for generating a copy stopper discordance signal.

FIG. 8 is a circuit diagram showing an embodiment of a circuit which produces the copy stopper discordance signal in response to a copy size signal supplied from the copying machine 40 if positions of the copy stoppers 153*a*, 153*b* do not correspond to the copy size.

In a cassette load unit of the copying machine 40, two switches are arranged in order to distinguish the three kinds of copy sizes. With the cassette loaded with A4 size papers, only a first switch is driven. When the cassette having A5 size paper is inserted into the cassette load unit, only a second switch is actuated. Finally, when the cassette containing legal size papers is loaded, both the two switches are driven. A signal produced upon actuation of the first switch is supplied at a first terminal 171 and a signal generated in response to the second switch is supplied at a second terminal 172. The first terminal 171 is connected through an inverter 173 to one inputs of AND gates 175 and 177 and is also connected directly to one terminal of an AND gate 176. Therefore, upon loading the cassette containing A4 size papers which drives only the first switch of the copying machine 40, the first terminal 171 becomes a low logical level (hereinafter called L level), so that an output of an AND gate 175 appears as a high logical level (hereinafter called H level) which is applied to one input terminal of AND gate 178. At this time, when it is assumed that the controlling lever 159 is located at the middle position in FIG. 7 and the switch $S_2$ is turned on as shown in FIG. 8, an H level signal is supplied to the other input terminal of the AND gate 178, so that an output of the AND gate 178 becomes an H level, and this output signal is applied to an output terminal 182 through an OR gate 181. On the contrary, if the controlling lever 159 is located in another position, the output signal of the AND gate 178 becomes an L level. At this moment, as the both output signals of the AND gates 176 and 177 are L level, the output signals of the AND gates 179 and 180 become also an L level and an L level signal appears on the output terminal 182. This signal is the copy stopper discordance signal.

In a similar manner, when the cassette having A5 size papers or legal size papers is loaded, the output signal of the AND gates 176 or 177 becomes H level, so that if either switch $S_1$ or $S_3$ is turned on, the output signal of either AND gate 179 or 180 becomes H level and the copy stopper discordance signal does not appear at the output terminal 182. But, if the controlling lever 159 is improperly positioned, the switch $S_1$ or $S_3$ is not turned on and the copy stopper discordance signal of L level appears at the output terminal 182. In the manner mentioned above, the copy stopper discordance signal is obtained in accordance with the signal which is supplied from the copying machine 40 to distinguish the copy size and with the signals of the switches $S_1$, $S_2$, $S_3$ which detect the position of the controlling lever 159.

Figures 2, 9:
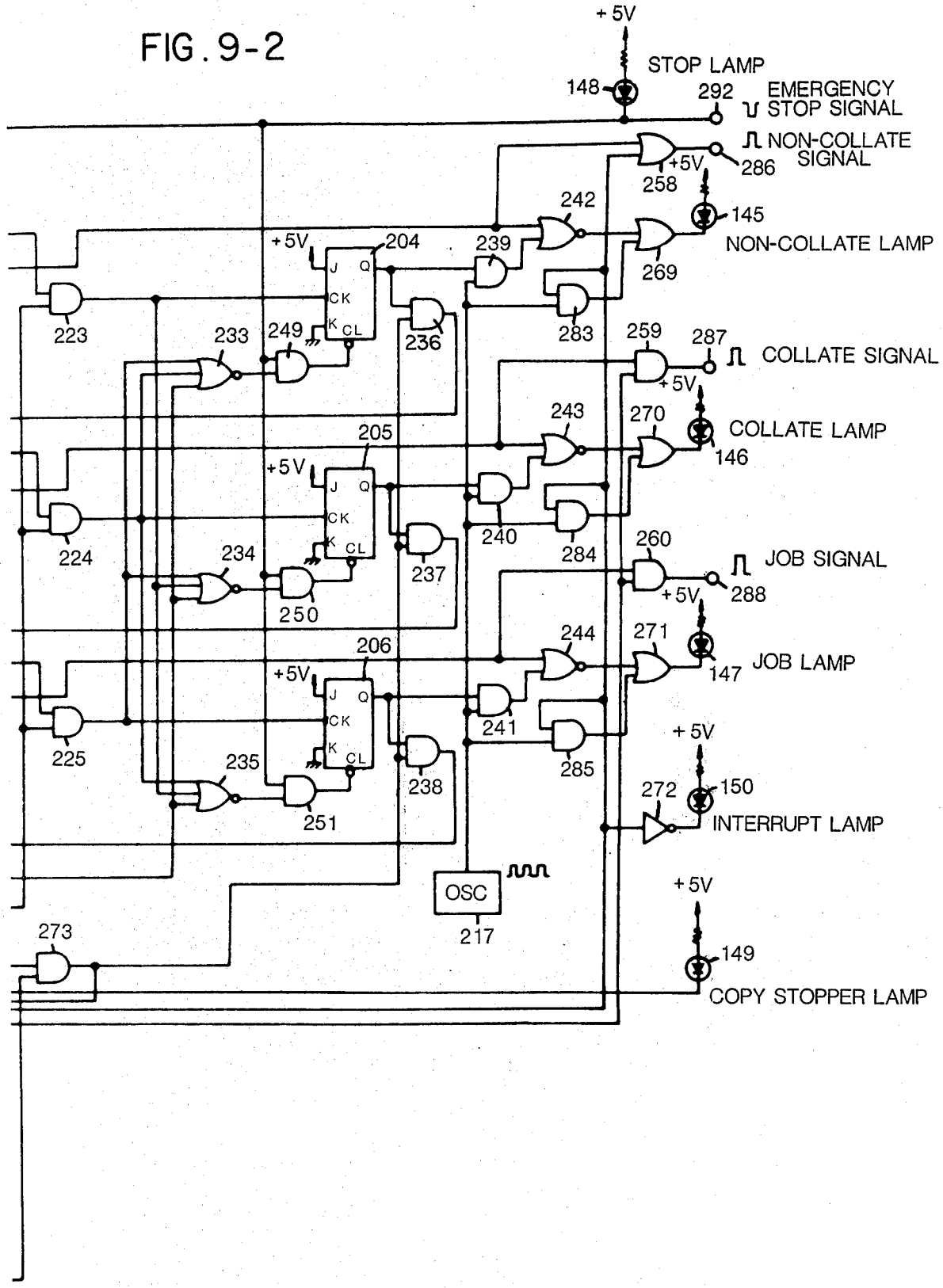
FIG. 9 is a circuit diagram showing a construction of an indicating lamp driving circuit.

FIG. 9 is a circuit diagram showing a construction of one embodiment of a driving circuit of various indicating lamps on the controlling panel mentioned above. Function of the driving circuit according to this embodiment is as follows.

(1) During performance of any one of the non-collate, collate, and job modes, a reservation for another mode to be performed next is capable and an indicating lamp for this reserved mode is turned on and off.

(2) If an interruption is performed while an operation of a certain mode is effected, this mode is remembered and an indicating lamp of this mode is turned on and off during this interruption.

(3) The mode of the indicating lamp which turns on and off is automatically started after the current operation is completed.

As illustrated in FIG. 9, the various switches 141–144 arranged on the controlling panel 140 are connected to outputs of a lamp controlling circuit and also various signals described below are supplied to input terminals 191–198 from the copying machine 40 and the collator 100. Input terminal 191 receives a collator alarm signal produced when a paper jam is detected in the collator. Input terminal 192 receives a collate or job end signal changing from H level to L level when the collate or job mode is ended.

Input terminal 193 receives a master reset signal MRS generated when a power supply is switched on.

Input terminal 194 receives the copy stopper discordance signal supplied from the output terminal 182 as illustrated in FIG. 8.

Input terminal 195 receives a paper detection signal supplied from the paper discharging detect switch 75 arranged in the outlet of the copying machine 40 as illustrated in FIG. 5.

Input terminal 196 receives a copy processing signal (hereinafter called a "copying signal") supplied from the copying machine 40, which copying signal becomes L level when the first copy of a certain document is detected by the paper discharging detect switch 75, and returns to H level, when the last copy of the relevant document is detected by the paper discharging detect switch 75.

Input terminal 197 receives an interruption signal produced by an interruption switch arranged in the copying machine.

Input terminal 198 receives a no-paper signal produced when copy papers have run out of the cassette loaded in the copying machine.

In FIG. 9 several pulse circuits which generate pulses upon receiving the input signals described above are arranged, and on the left side of each pulse circuit is a sign ↑ or ↓ which denotes whether the pulse circuit produces an output pulse in response to ascending or descending edge of the input signal. Also on the right side, there is shown a mark ⎍ or ⎏ indicating that the level of the output pulse is H or L level.

All the flipflops used in this embodiment are JK flipflops, so that Q and $\overline{Q}$ outputs become H and L level, respectively, when the flipflop is set by supplying the H level signal to a CK input terminal, and Q and $\overline{Q}$ outputs become L and H level, respectively, when the flipflop is reset by supplying the H level signal to the CL input terminal. Furthermore, since the indicating lamps 145–150 are formed by light-emitting diodes, these lamps are switched on if the cathodes of diodes become L level and are switched off if the cathodes become H level. Now, construction and operation of the controlling circuit for driving the indicating lamps will be explained for the various operation modes.

(1) At the time when the power supply is switched on.

When the power supply of the collator is switched on, the master reset signal MRS having H level is applied to the input terminal 193. This signal is applied through an OR gate 252, sets a flipflop 201 (hereinafter abbreviated as FF) through an OR gate 227, and resets FFs 202, 203, 204, 205, and 206 through OR gates 231, 232, 233, 234, 235, and AND gates 247, 248, 249, 250, 251. If FF 201 is reset, the Q output of FF 201 becomes H level and thus, the output of a NOR gate 242 becomes L level. Thus the cathode of the non-collate lamp 145 is made L level through an OR gate 269, so that the non-collate lamp 145 is switched on. On the other hand, the Q output of FF 201 is supplied to an output terminal 286 through an OR gate 258, so that the non-collate signal having H level appears at the output terminal 286. Moreover, if FFs 202–206 are reset, all the Q outputs of these FFs become L level and the cathodes of light emitting diodes of the collate lamp 146 and job lamp 147 are made H level through NOR gates 243, 244 and OR gates 270, 271, so that these lamps are not switched on. That is to say, the collator is set to the non-collate mode at the time when the power supply is initially switched on. In this mode of operation, the solenoid 111 illustrated in FIG. 5 is energized.

(2) At the time when the copy stopper is discordant.

As described above in connection with FIG. 7 and FIG. 8, when the size of the copy papers in the cassette loaded into the copying machine 40 is different from the positions of the copy stoppers 153*a*, 153*b* in the collator, the copy stopper discordance signal of L level is produced and supplied to the input terminal 194. Then AND gates 218 and 219 are disabled and thus, even if an output pulse is applied from the pulse circuit 211 or 212 by driving the collate switch 142 or the job switch 143, the pulse does not pass through the AND gate 218 or 219. Therefore, the FFs 202 and 203 which control the collate and job operations, respectively, are not set and the collator does not operate in the collate or job mode. On the contrary, the cathode of the diode constituting the copy stopper discordance lamp 149 becomes L level, this lamp is switched on. When the copy stopper discordance signal is generated, the solenoid 111 illustrated in FIG. 5 is energized to rotate the guide plate 101*a* to the position shown by a chain line, and all copies discharged from the copying machine 40 are stuck on th extra tray 109.

Next, an operation of the collator will be explained when the copy stoppers 153*a*, 153*b* are erroneously moved by accident, while the collator is performing the collate or job mode. As the solenoid 111 is not energized during the collate or job mode, a copy is not discharged on the extra tray 109, but is introduced into the main body of the collator. If, in this condition, the copy stoppers are moved from the correct position, the copy stopper discordance signal of L level is produced immediately. Then the solenoid 111 is energized, and at this time the copy might unexpectedly be pressed by the guide plate 101*a*, so that the copy might be jammed. In order to overcome such fault, not only the copy stopper discordance signal but also the output signal of the paper discharge detecting switch 75 arranged in the copying machine 40 are supplied to an OR gate 253. Therefore, even if the copy stopper discordance signal of L level is produced, when the copying machine discharges a copy, since the output signal of the paper discharge switch 75 is H level, an output signal of the OR gate 253 remains at H level. When the discharge of this copy is finished, the output signal of the OR gate 253 changes from H level to L level. The pulse produced from a pulse circuit 214 detecting the descending edge of the output signal is applied to the OR gate 252 through an AND gate 266, so that FF 201 is set, but FFs 202–206 are reset, and the non-collate mode is carried out. In this manner, by driving the guide plate 101*a* after discharging the said copy completely, no paper jam occurs. As described above, since the AND gates 218, 219 are disabled in this state, the collate mode and job mode could not be accepted even if the collate switch 142 or job switch 143 is closed.

(3) Movement before supplying copies.

In this case, the copying signal at the input terminal 196 remains at H level, so that AND gates 220, 221, 222 are enabled, but AND gates 223, 224, 225 are disabled due to an inverter 226. If the copy stopper discordance signal does not appear and the copying signal is H level, the AND gates 218, 219 are enabled. In this condition upon actuating the collate switch 142, an output pulse having H level is generated from the pulse circuit 211 and this pulse is supplied to a CK terminal of the FF 202 through the AND gates 218, 221 and the OR gate 228, so that this FF 202 is set. On the other hand, the pulse from the AND gate 221 is supplied to a CL terminal of the FFs 201 and 203 as an L level signal through the NOR gates 230, 232 and the AND gates 246, 248, so that these FFs 201 and 203 are reset. Therefore, the collator is set up for the collate mode, so that the collate lamp 146 is switched on and also a collate signal appears at a terminal 287 by means of an AND gate 259.

In the next place, when the job switch 143 is pressed, an output signal appears from a pulse circuit 212 and FF 203 is set through the AND gates 219, 222 and an OR gate 229, so that the job lamp 147 is switched on and also a job signal appears at a terminal 288 through an AND gate 260. On the contrary, FFs 201, 202 are reset through the OR gates 230, 231 and the AND gates 246, 247. In this way, the collator is set up for the job mode.

When the non-collate switch 141 is pressed, the FF 201 is set by an output pulse from a pulse circuit 210 and FFs 202, 203 are reset, so that the collator is set up for the non-collate mode. Then, the non-collate lamp 146 is switched on, and the non-collate signal appears at the output terminal 286.

In this manner, in the condition before feeding a copy, if any of the non-collate switch 141, the collate switch 142, and the job switch 143 is pressed, the mode corresponding to the selected one is set, and any of the indicating lamps 145, 146, 147 corresponding to the selected one is switched on. When the collate switch 142 or the job switch 143 is pressed, a timer 263 is actuated. If the copying machine does not supply a copy during a given time of the timer, the timer is reset after the given time and a pulse circuit 213 receives the signal from the timer through an OR gate 264 and produces an output pulse in response to a change of said signal from H level to L level. This pulse is supplied through the AND gate 254 and OR gate 252 to FFs 201–206, so that FF 201 is set and FFs 202–206 are reset. That is to say, even if the collate switch 142 or the job switch 143 is actuated, the collator returns automatically to the non-collate mode as long as no copy is supplied from the copying machine. The timer 263 is of a reflesh type and thus, every time the collate switch or the job switch is pushed, new cycle is performed.

(4) Copy processing operation

As described above, the mode selected at copy starting for a certain manuscript proceeds to the end of a copying operation for this manuscript, and during this operation the corresponding mode indicating lamp continues to be made on. During the duplicating operation the copying signal supplied from the copying machine remains at L level and thus, AND gates 220, 221, and 222 are disabled. Thus, if an output pulse is supplied from any one of the pulse circuits 210, 211, and 212 and any one of the non-collate switch 141, the collate switch 142, and the job swtich 143 is pushed, this output pulse does not pass through AND gates 220, 221, and 222, so that there occurs no change in the state of FFs 201, 202, and 203.

(5) Operation for reserving the collate mode

As mentioned above, since the copying machine 40 according to this embodiment is of the retention type, during the duplicating operation for a certain document it is possible to set the next document for preparation. In the present collator, it is possible to reserve the operation mode to be effected for copies of the next document at the time of setting the next document of the copying machine. For instance, when current copies of the first document are treated in the collate mode, if it is desired to treat copies of the next document in the non-collate mode and to discharge the copies of the next document onto the extra tray 109, an operator can reserve the non-collate mode, while the collator treats the current copies of first document in the collate mode. Further it is also possible to reserve the collate or job mode for the copies of the next document, while the collator treats the copies of the first doucment in the non-collate mode. The mode reserved for the next manuscript is indicated by turning the corresponding lamp on and off. In this way the operator can easily see the mode which has been reserved and is to be executed next. Therefore, on the controlling panel 140 the lamp indicating the mode under which the current copies are treated is switched on, and also the lamp indicating the mode reserved for the next manuscript turns on and off. When the copying operation for the first document has been finished and the copying operation for the next document is started, the collator is automatically driven into the reserved mode. At the same time the indication lamp of the reserved mode is continuously turned on and the indicating lamp of the previously executed mode is switched off.

In FIG. 9, since the copying signal for the current manuscript under duplication is L level, AND gates 220, 221, 222 are disabled and thus, even if any one of the non-collate, collate and job switches is actuated, there is no change in the state of FFs 201–203. However, the same copying signal passes through the inverter 226 and thus, AND gates 223, 224, 225 are made enable. Therefore, when any one of the non-collate switch 141, collate switch 142 and job switch 143 is driven, an output pulse from any one of the pulse circuits 210, 211, 212 passes through AND gates 223, 224, 225, and then any one of FFs 204–206 is set. For instance, if the non-collate switch 141 is switched on during the collating mode, an output pulse is derived from the pulse circuit 210 and FF 204 is set through AND gate 223. The Q output of FF 204 becomes H level and thus AND gate 239 is enabled. Since a pulse series having a frequency of 2 Hz generated from an oscillator 217 is applied to the other input terminal of this AND gate 239, the pulse signal appears on an output side of the AND gate 239 and is further supplied to a NOR gate 242. Since the signal of L level is applied from the Q output terminal of FF 201 to the other input of this NOR gate 242, an output of the NOR gate 242 corresponds to the pulse series having the repetition frequency of 2 Hz from the oscillator 217 and thus, the non-collate lamp 145 turns on and off at a cycle of 2 Hz. After that if the job switch 143 is switched on, an output pulse is produced from the pulse circuit 212, FF 206 is set through AND gates 219, 225, and also FFs 204, 205 are reset through NOR gates 233, 234. That is to say, the non-collate lamp 145 is switched off and the job lamp 147 is turned on and off. Moreover, if the collate switch is pushed before the collate mode ends, FF 205 is set and FFs 204, 206 are reset. Therefore, the non-collate lamp 145 or the job lamp 146 which has been turned on and off is switched off. If the FF 205 is set, its Q output becomes H level and the output of an AND gate 240 is changed between H and L levels in synchronism with the oscillating cycle of the oscillator 217, but since the signal of H level is supplied from Q output terminal of FF 202 to the other input terminal of NOR gate 243, an output of the NOR gate 243 is remained at L level and thus, the collate lamp 146 is turned continuously on. Therefore, every time another mode switch is pushed in processing the copying operation, the indication lamp corresponding to the reserved mode is turned on and off.

In the next place, the automatic change in the operation of the collator from the current mode into the reserved mode will be explained. It is assumed that the current mode is the collate mode, with FF 202 set, and the non-collate mode is reserved for the next mode with FF 204 set (in this case the collate lamp 146 is switched on and the non-collate lamp 145 is turned on and off during the relevant copying operation). The copying signal changes from L level to H level at the end of the current copying operation for the first manuscript. The pulse circuit 215 respods to this signal change and produces the pulse. Upon appearance of this pulse, AND gates 236, 237, 238 are enabled. As the non-collate state has been reserved, Q output of FF 204 becomes H level and the pulse of H level appears on an output of AND gate 236. This pulse is supplied to OR gates 227, 231, 232, FF 201 is set and FFs 202, 203 are reset. In this way, the non-collate state is set and the collate state is reset. Therefore, if a copy for the next manuscript is fed, the collator can treat it in the non-collate mode and the copy is discharged on the extra tray 109. If the collate or job mode is reversed, the collator is automatically set in the reserved mode in the same way and FF 202 or FF 203 is set and the other FFs are reset.

(6) Operation after completion of duplication

If the collate or job mode has been finished but a new duplicating operation for a next manuscript is not started, a collate or job end signal is supplied to the input terminal 192. This signal is changed from H level to L level at the end of the current operation mode. This signal is supplied through OR gate 264 to the pulse circuit 213. At this time, if the timer 263 which is driven by the collate switch 142 or job switch 143 has been released and its output is L level, the pulse circuit 213 produces the output ulse. This output pulse passes through AND gate 254 and OR gate 252, and sets FF 201 through OR gate 227 and also resets FFs 202, 203, 204, 205, 206 through NOR gates 231, 232, 233, 234, 235 and AND gates 247, 248, 249, 250, 251. In this manner, the collator returns automatically to the non-collate state.

(7) Operation of the collator alarm on the emergency stop

If the emergency stop switch 144 is turned on, an output of AND gate 245 becomes L level, and outputs of AND gates 246–251, 282 become L level, because the switch 144 is of the alternative type. That is to say, all FFs 201–206, 208 are reset, the non-collate lamp 145, the collate lamp 146 and the job lamp 147 are switched off (if at this time being switched on) and the energency stop lamp 148 is switched on.

Subsequently, if the collator alarm signal is supplied to the input terminal 191, while the energency stop swtich 144 is turned off, FF 207 is set through inverter 261 and this $\overline{Q}$ output becomes L level, so that an output of AND gate 245 becomes L level and then FFs 201–206 are reset. In the same way, the non-collate lamp 145, the collate lamp 146, and the job lamp 147 are switched off and the emergency stop lamp 148 is switched on. In order to reset such a collator alarm state (that is, the state in which FF 207 is set), the emergency stop switch 144 is once switched on and then switched off. At this time, a pulse of L level appears on an output of the pulse circuit 209, FF 207 is reset, and $\overline{Q}$ output of this FF 207 becomes H level. Since the signal of H level is supplied from the emergency stop switch 144, the output of AND gate 245 becomes H level. Moreover, as the output of the pulse circuit 209 is supplied to the OR gate 227 through an inverter 267, FF 201 is set and then the collator is set in the non-collate state.

(8) Operation at an interruption

Since the copying machine according to this embodiment of the retention type, it is preferable that if an interruption occurs in producing multiple copies for a certain document, the copying action for the relevant document should not be stopped at once, but is postponed until the predetermined number of copies of the relevant document have been formed. Like the usual document, the manuscript to be interrupted can be set into the copying machine while the duplicating operation of the current manuscript is being performed. Further, it is preferable to select or reserve the interruption in the copying machine at this time. The curcuit according to this embodiment is constructed so as to perform such a function. That is to say, if an interruption switch of the copying machine 40 is actuated, the collator continues to process copies of the document in the same mode till the final copy of this document has been treated, and the interruption is effected for the next manuscript. During the interruption mode, one or more copies of the document are discharged on the extra tray 109. At the interruption is released, copies of a next document will be treated under the mode previously set before the interruption. That is to say, if the mode before interruption is the collate mode, the collating operation is performed from the first bin, and if the job mode, the job operation is started from the next bin.

If an interruption occurs on the copying machine 40 during the copying operation, the interruption signal of L level is applied to the input terminal 197. Therefore, an output of an AND gate 274 becomes L level, and if any one of the non-collate switch 141, the collate switch 142, and the job switch 143 is turned on, there is no change in the states of FFs 201–206. Moreover, since the AND gate 254 is disabled, even if the copying operation is finished, the collator cannot return automatically to the non-collate mode.

When the interruption signal is supplied and the copying signal becomes H level after the copying process of the current manuscript has been finished, the pulse circuit 215 produces an output pulse. As this pulse is supplied to an AND gate 256 through an AND gate 273, and the output of AND gate 256 becomes H level, a FF 208 is set. If FF 208 is set, Q output of this FF becomes H level. Therefore, the output of the OR gate 258 becomes H level and the outputs of AND gates 259, 260 become L level and thus, the collator is forcedly set into the non-collate mode.

In this way, during the interruption, no signal is supplied to input terminals of FFs 201–206 at all, and the non-collate mode is exclusively selected by means of gates 258, 259, 260, as such, all copies of the manuscript during the interruption are discharged on the extra tray 109. Moreover, FFs 201–206 maintain the same state they held before interruption. If the interruption is released, the signal on the input terminal 197 becomes H level, so that at the end of the copying signal of the interruption an output pulse is produced from the pulse circuit 215 and a pulse of L level appears on an output of AND gate 257. This pulse resets FF 208 through an AND gate 282. Therefore, $\overline{Q}$ output of FF 208 becomes L level and $\overline{Q}$ output becomes H level and thus, the collator is automatically returned to the previous mode which had been executed before the interruption.

As mentioned above, since FF 208 is set in processing the copies of the interrupting manuscript, the cathode of the light-emitting diode of the interruption lamp 150 becomes L level through an inverter 272 and the lamp 150 is switched on. During the interruption, the previous mode before the interruption is stored in any one of FFs 201–203 which has been set. Therefore, the Q output of the FF in set condition remains at H level and is supplied to any one of OR gates 269, 270, 271 through any one of NOR gates 242, 243, 244. At the same time, since the output signal of the oscillator 217 appears on the output side of any one of OR gates 269–271 through any one of AND gates 283–285, any one of mode indicating lamps 145–147, which was turned on before the interruption, is turned on and off, so that the operator can easily percept the operation mode which was executed before the interruption. For instance, when the mode before the interruption was the collate mode, FF 202 has been set, so that Q output of this FF becomes H level, and the output of the NOR gate 243 is L level and applied to the OR gate 270. Since the oscillating signal of 2 Hz is supplied to this OR gate through an AND gate 284, the collate lamp 146 is turned on and off at 2 Hz cycle. When the interruption is set free, FF 208 is reset, so that Q output of this FF becomes L level, all outputs of AND gates 283, 284, 285 become L level, and the lamp 146 of the collate mode which was executed before the interruption is again switched on.

(9) Operation with no paper in the copying machine

When there is no copy paper in the cassette during the copying operation, the remaining number of copies to be formed for the relevant document is memorized by the copying machine. Subsequently, after new papers are placed in the cassette, the copying machine restarts to produce the remaining number of copies for the relevant manuscript. In the collator, when the no paper signal is supplied to the input terminal 198 during the copying action, the mode under processing is stored, and then, if the copying action is started again, this mode is again performed. For example, when there is no paper in the cassette during the collating action, the distributor stops at a current bin, and then when the copying action is started again, the collating action is started from the next bin. In FIG. 9, if the copying signal is L level and at this time the no paper signal is supplied to the input terminal 198, both inputs of an OR gate 278 become L level and thus, an output of this gate becomes L level. At this time, a pulse circuit 279 generates an output pulse which is supplied to one input of an AND gate 280. The copying signal of L level which is inverted by an inverter 277 into H level is supplied to the other input of the AND gate 280. Therefore, a pulse of H level appears on an output of the AND gate 280, and a FF 281 is set. Accordingly, Q output of the FF 281 becomes L level and an output of an AND gate 274 becomes L level, so that all AND gates 268, 218, 219, 254 are disabled. Thus, even if any one of the non-collate switch 141, the collate switch 142 and the job switch 143 is actuated, a pulse signal does not pass through these AND gates and there is no change in the state of FFs 201–203. Moreover, if the collate-job end signal becomes L level and then an output pulse is produced from the pulse circuit 213, this pulse does not pass through the AND gate 254 and the collator does not return to the non-collate state.

Besides, since the AND gate 273 is disabled by the Q output signal of L level of FF 281 even if the copying signal during which the no paper state occurs becomes H level and an output pulse is generated from the pulse circuit 215, this output pulse does not pass through the AND gate 273. As mentioned above, there is no change in the state of FFs 201–203, and the mode at the time when there is no paper is maintained. In the next place, if papers are supplied in the cassette of the copying machine and the duplicating operation for the remaining copies is restarted, a pulse circuit 276 responds to a signal change to L level of the copying signal to produce an output pulse of L level and then the FF 281 is reset. Therefore, Q output of FF 281 becomes H level, so that the collator is returned to a normal operation.

Figure 10A:
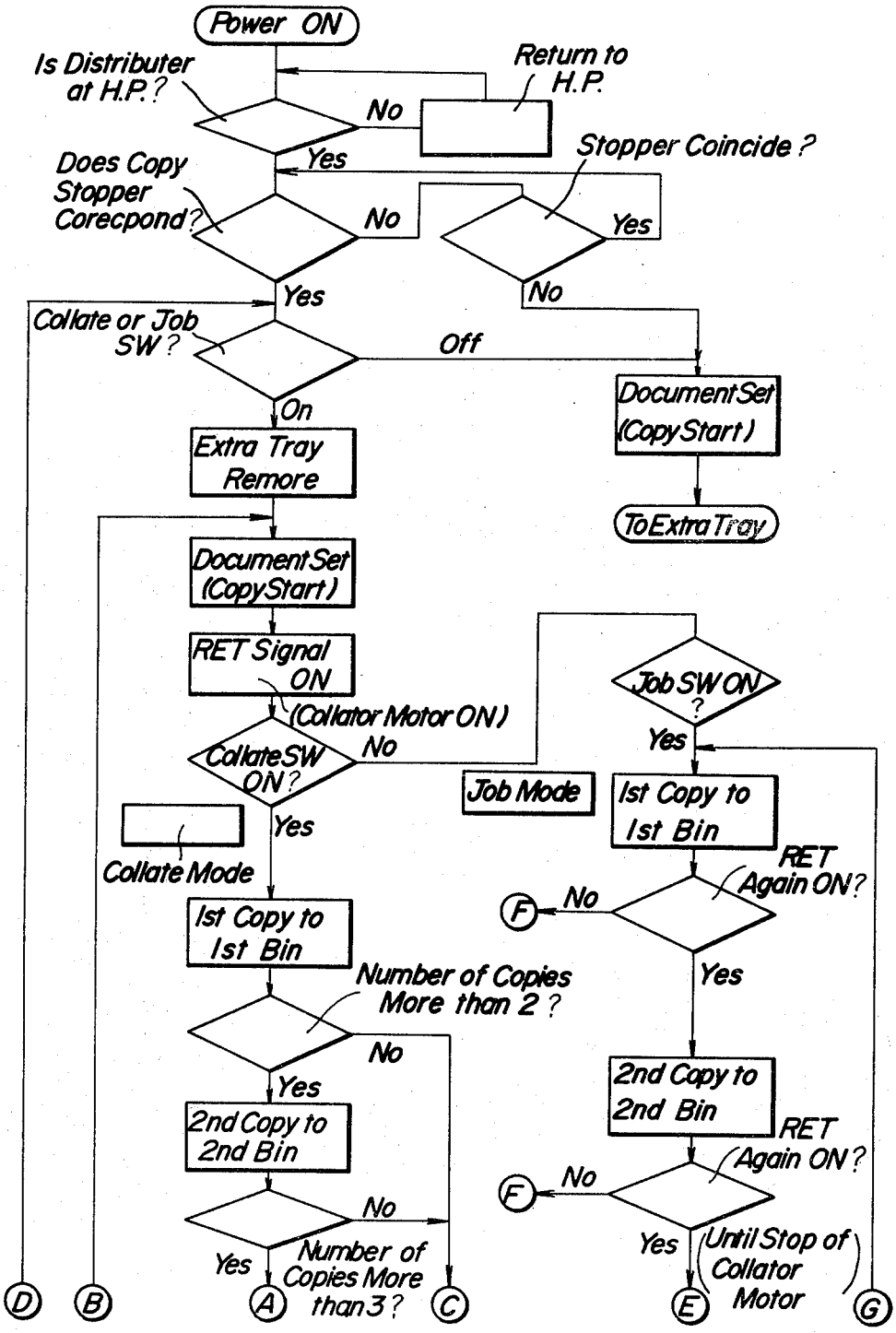
FIGS. 10A and 10B are diagrams illustrating a flow chart for explaining the collator operation.
Figure 10B:
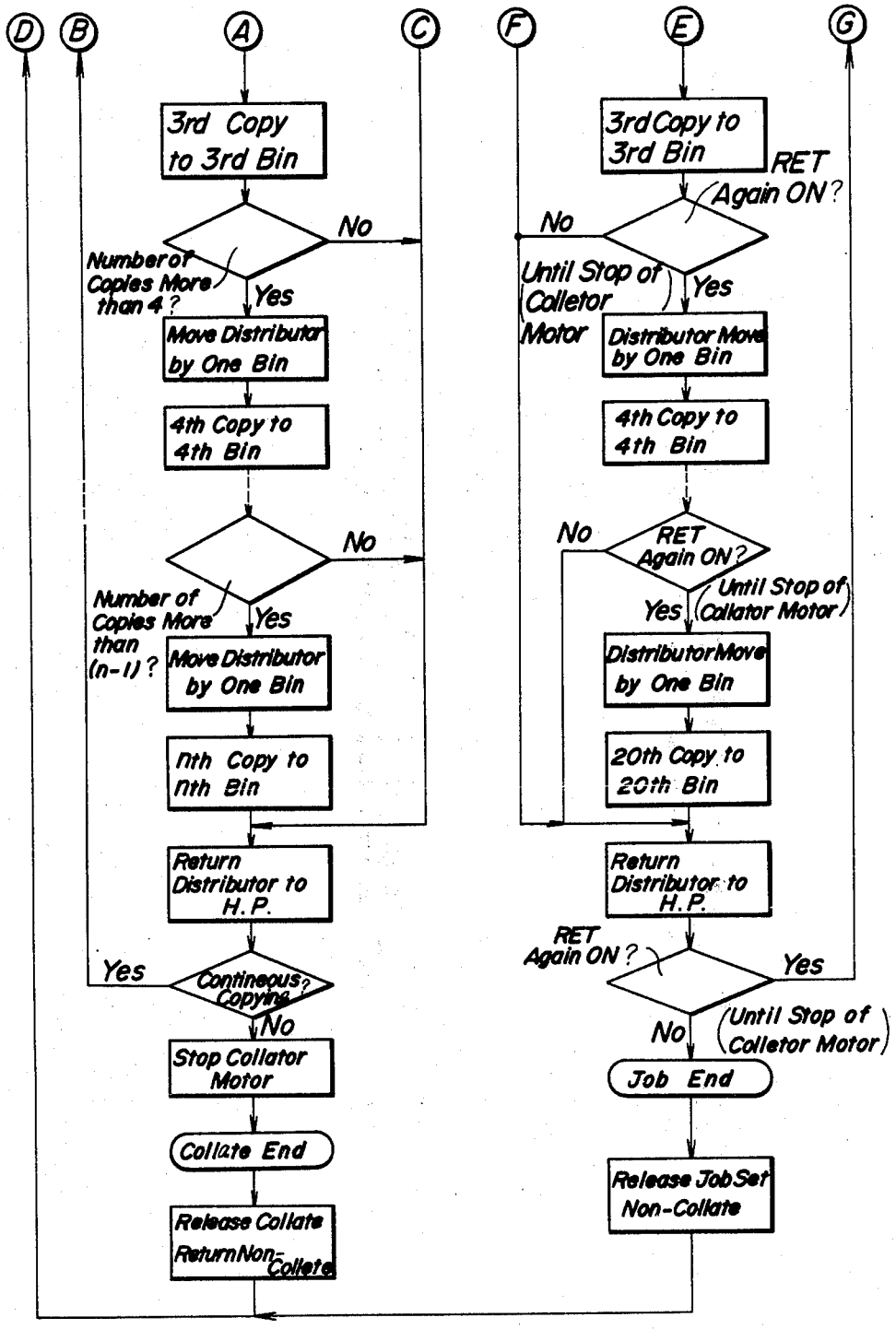

Now the operation of the whole collator according to this embodiment will be explained with reference to flow chart illustrated in FIGS. 10A and 10B.

In an initial condition, if the distributor 130 is not located at a position of the third bin 120-3, that is the home position H.P, this distributor must be returned to the H.P at first. At the H.P there is provided a microswitch 300 (see FIG. 5) for detecting the distributor 130. When this microswitch is not turned on, the distributor 130 must be returned to H.P.

Subsequently, it is decided whether a size of papers in the cassette of the copying machine 40 does correspond to the positions of copy stoppers 153*a*, 153*b* in the collator 100 or not. If there is no accordance between the copy paper size and the positions of copy stoppers 153*a*, 153*b*, the copy stopper discordance signal occurs and then all the copies supplied from the copying machine are discharged on the extra tray 109. If there is an accordance and one of the collate switch 142 and the job swtich 143 is switched on, the guide plate 101*a* moves into the position as illustrated by a solid line in FIG. 5. When the non-collate switch is turned on, the collator is set to the non-collate mode and the copies are discharged on the extra tray 109. However, when the collate switch 142 or job switch 143 is actuated, the collator is set into the collate or job mode.

(1) Collate mode

At first, the collate mode will be explained. During the copy process in the copying machine 40, the first copy is inserted into the first bin 120-1, and if the number of copies to be formed for the relevant document is more than two, the flow proceeds in the YES direction and, if not, proceeds to a mark Ⓒ through a sign NO. If more than two sheets, the second copy is delivered into the second bin 120-2 and at this point it is decided whether or not the required number of copies is more than three. If more than three, the third copy is inserted into the third bin 120-3 and, if not, the process proceeds to the mark Ⓒ. After the third copy has been inserted into the third bin 120-3, it it decided whether or not the number of copies to be collated is more than four. If not more than four, the process proceeds to the mark Ⓒ. If more than four, in order to insert the fourth copy into the fourth bin 120-4, the distributor is moved from the home position corresponding to the third bin 120-3 to the position of the fourth bin. There are various ways for moving the distributor 130 by one bin, hereinafter one of them will be explained. After the fourth copy has been supplied into the fourth bin 120-4, it is decided whether or not the number of copies is more than five. If not more than five, the process proceeds to the mark Ⓒ. If more than five, the distributor 130 is moved to an inlet of the fifth bin and the fifth copy is delivered into the fifth bin 120-5. The above mentioned movement is repeated until n sheets are set up in the copying machine 40 (in this embodiment the maximum number of copies for a manuscript is limited to twenty). Generally after proceeding to an nth sheet and delivering it into the nth bin, the distributor is returned to H.P.

At this time, it is observed whether the production of copies for the next manuscript has already been started or will be done within a certain time interval. If started, the flow returns to a mark Ⓑ. If the next copying operation is not started within the certain time interval, the collating mode is ended and the collate state is returned to the non-collate state as explained above with reference to FIG. 9.

(2) Job mode

In the job mode, all the copies for the first manuscript are inserted into the first bin 120-1. Subsequently, if the copy forming action for the next manuscript is started within a certain time interval, all the copies for the second manuscript are delivered into the second bin 120-2. However in this embodiment, if the number of copies to be formed for respective documents is set to one, all copies for different documents will be inserted into the first bin 120-1.

Therefore in this embodiment, as for the signal for detecting whether the copying action for the next manuscript is started or not within the certain time interval, use is made of the multiple or retention copying signal (RET signal). This RET signal shown in a time chart as mentioned below, becomes L level in duplicating the first copy of a manuscript and changes to H level in performing the last copy of the same in the multiple copying (more than two sheets).

After the copies of more than two sheets of the second manuscript are inserted into the second bin 120-2 in performing the job action, it is observed whether the copying action for the next, i.e. third manuscript is started again or not within the certain time interval. If the copying action for the third manuscript is started, all the copies of the third document are delivered into the third bin 120-3. If not started, the flow proceeds to a mark Ⓕ. After inserting the copies into the third bin 120-3, if the copying action for the next, i.e. fourth manuscript is started again within said time interval, the distributor 130 is moved to an inlet of the 4th bin 130-4 and all the copies for the fourth manuscript are inserted into the 4th bin 120-4. After inserting all the copies into the fourth bin 120-4, if the new copying action is not started within the certain time interval, the flow proceeds to a mark Ⓕ. In the manner mentioned above, all copies of respective manuscripts are supplied into the successive bins. All the copies for the twentieth manuscript are supplied into the twentieth bin 120-20. Subsequently, if the copying action for the 21st manuscript is started, the flow returns to a mark Ⓖ, so that all the copies for this 21st manuscript are inserted into the first bin 120-1. of course prior to this time, the copy of the first manuscript already present in the first bin 120-1 may be removed or may be left there.

After inserting copies of successive manuscripts into the successive bins, if the copying action for the next manuscript is not started again within said time interval, the distributor 130 is returned to H.P. and also the job state is ended, so that the job state is set free as explained in connection with FIG. 9 and the non-collate state is automatically attained.

Figures 1, 11:
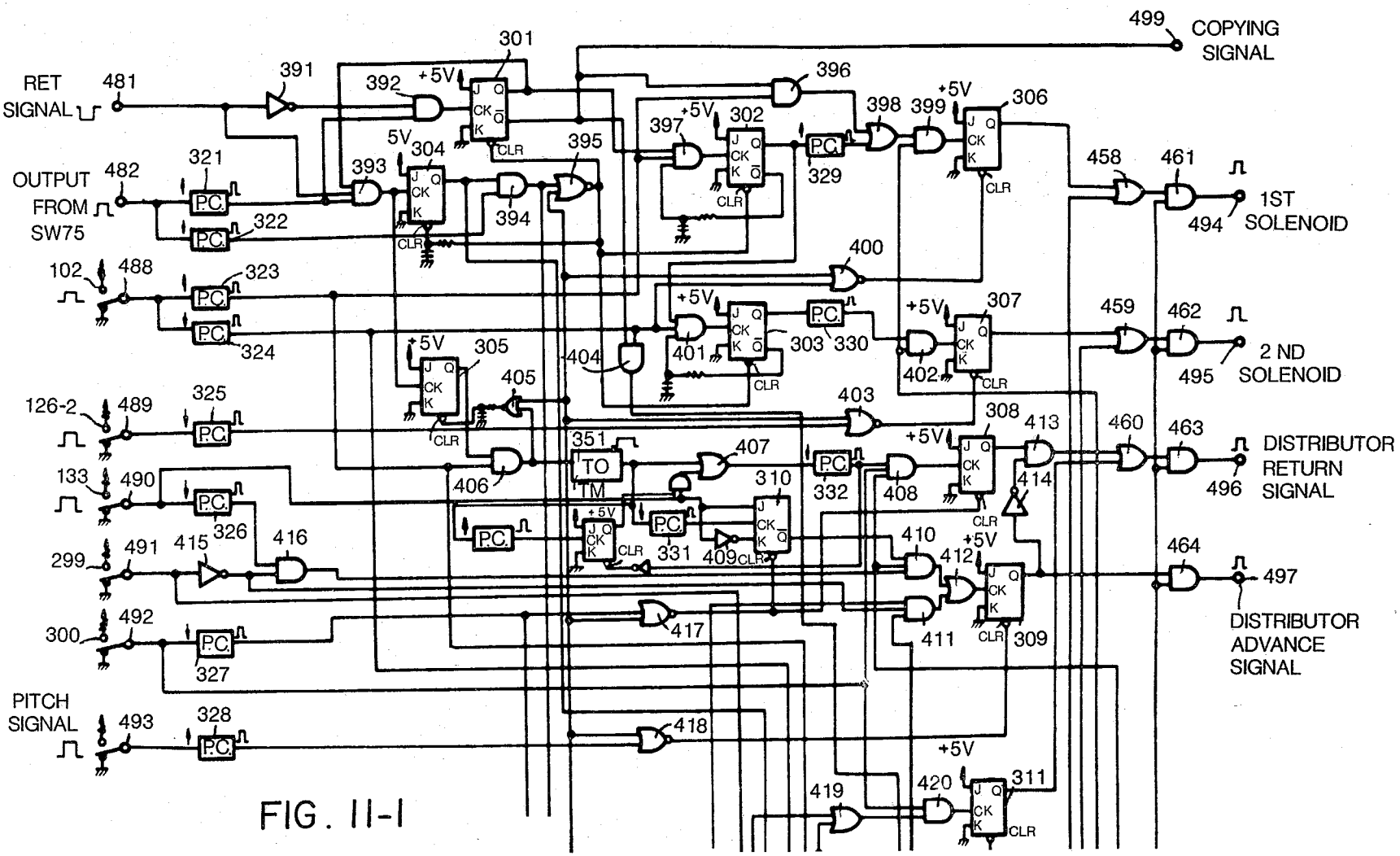
FIG. 11 is a circuit diagram depicting a construction of a collator driving and controlling circuit.
Figures 2, 11:
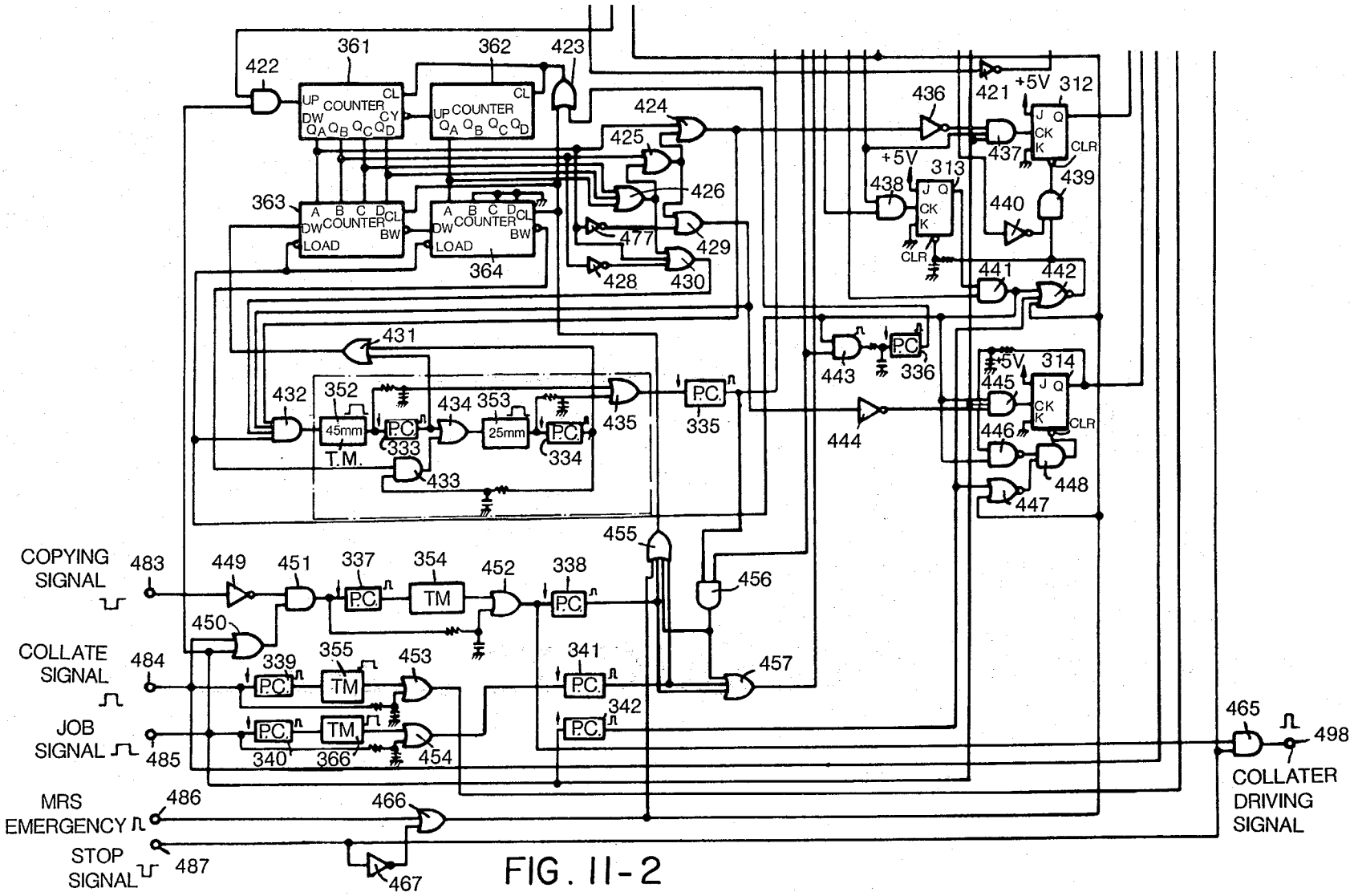

FIG. 11 is a circuit diagram showing one embodiment of a collator driving and controlling circuit which generates a signal that energizes solenoids 124-1 and 124-2 for driving the deflection claws arranged at the first bin 120-1 and the second bin 120-2, respectively, a signal for driving the distributor 130, and a signal for driving the feed rollers 125-1 and 125-2 arranged at inlets of the first and the second bins, respectively. In FIG. 11, reference numerals 301–314 show JK flip-flops, 321–342 represent pulse circuits, and 351–356 denote timers. If a pulse of H level is applied to an input of the timer, it produces an output of H level only for a given time period. Reference numerals 361–364 shows counters of which the counters 361, 362 and 363, 364 are upcounters and downcounters, respectively (respective counters can be composed of an IC, for example, SN74193). Further reference numerals 391–467 denote OR gates, AND gates, NOR gates, inverters, and NAND gates, and 481–493 and 494–498 represent input terminals and output terminals, respectively. At these terminals the following signals appear.

Input terminal 481 receives the multiple copying signal (RET) which is supplied from the copying machine and becomes L level during the copying action.

Input terminal 482 receives a signal which is supplied from the paper discharge detecting switch 75 arranged in the copying machine (see FIG. 5) and becomes H level during a passage of the copy.

Input terminal 483 receives the copying signal which is supplied from the copying machine and upon starting the copying action becomes L level, and after the end of this copying action continues to be L level until a time required for producing one more copy, i.e., the last copy has passed.

Input terminal 484 receives the collate mode signal which appears on the output terminal 287 of the circuit shown in FIG. 9.

Input terminal 485 receives the job mode signal which appears on the output terminal 260 in FIG. 9.

Input terminal 486 receives the master reset signal which becomes H level when the power supply is switched on.

Input terminal 487 receives the emergency stop mode signal which appears on the output terminal 292 in FIG. 9.

Input terminal 488 receives the output signal produced by the switch 102 arranged at the copy inlet of the collator shown in FIG. 5, and becomes H level during a passage of the copy.

Input terminal 489 receives the output signal from the copy detecting switch 126-2 and becomes H level upon detection of the copy.

Input terminal 490 receives the output signal from the switch 133 arranged on the distributor 130 and becomes H level during a passage of the copy.

Input terminal 491 receives the signal supplied from a microswitch 299 that detects whether the distributor 130 is located at a position of the last bin, that is, the twentieth bin 120-20 or not as shown in FIG. 4.

Input terminal 492 receives the signal supplied from a switch 300 arranged at the home-position for detecting the distributor 130 as illustrated in FIGS. 4 and 5, said signal being L level when the distributor is located at the home-position.

Input terminal 493 receives a pitch signal which is supplied from switches that detect successive movements of the distributor 130 bin by bin, and becomes H level if the distributor 130 moves into respective bin positions.

The pitch signal supplied to the last input terminal 493 may be generated by various means. For example, the distributor contains a photo coupler comprising a light source and a light receiving unit. Between the light source and the light receiving unit is arranged, along a moving path of this distributor, a frame having formed therein openings at positions corresponding to the respective bins. The pitch signal can be generated from said photo coupler, every time it detects said openings. Next, signals which appears on output terminals 494–498 will be explained hereinbelow.

Output terminal 494 sends a signal which drives the first bin solenoid 124-1 for driving the first bin deflection claw 123-1.

Output terminal 495 sends a signal which drives the second bin solenoid 124-2 for actuating the second bin dfelection claw 123-2.

Output terminal 496 sends a signal which drives the distributor driving motor 136 (FIG. 4) so as to return the distributor 130 to H.P.

Output terminal 497 sends a signal which drives the distributor driving motor 136 so as to move the distributor by one bin pitch downward.

Output terminal 498 sends a signal which drives the copy travelling belts 104, the suction fan 107, and the feed rollers 125-1, 125-2 and so on, in performing the collate and job mode operations.

Figures 1, 12:
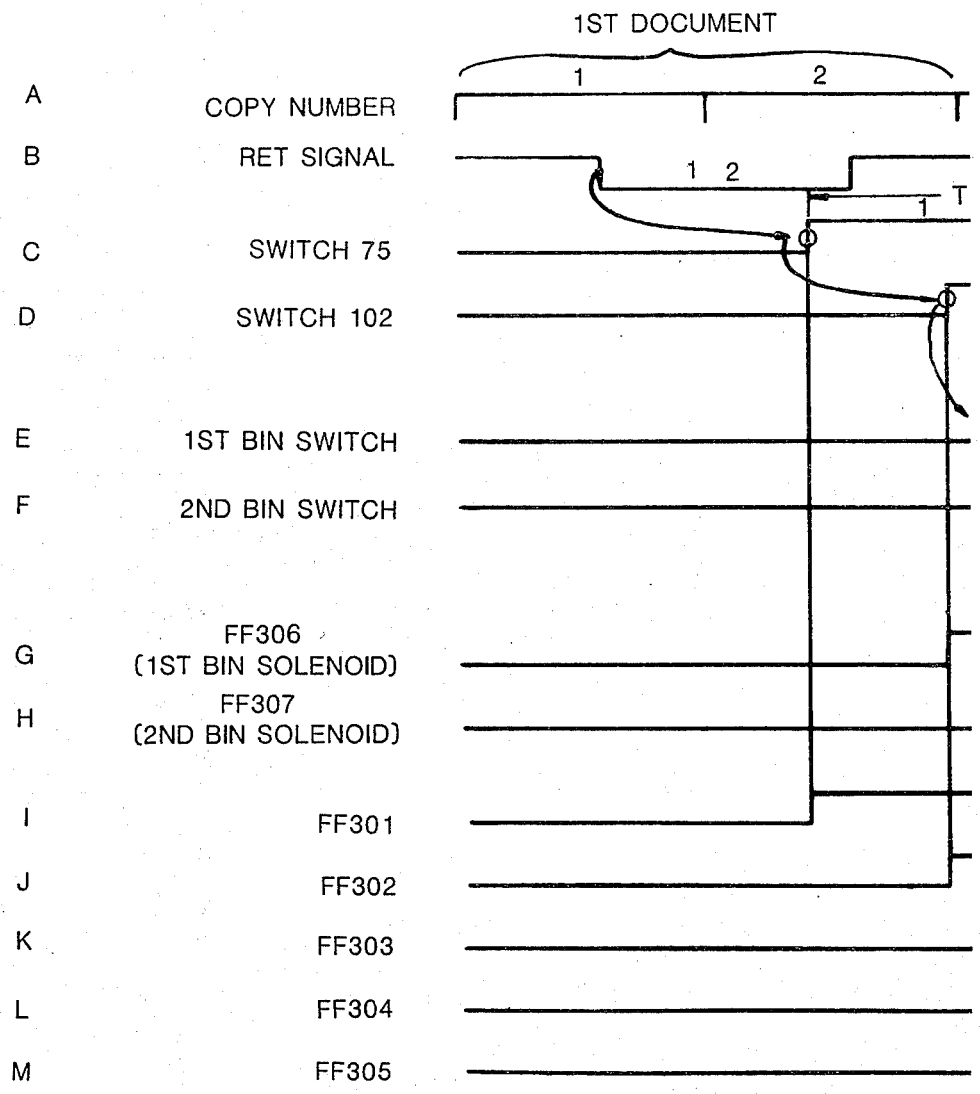
FIG. 12 is a diagram illustrating signal waveforms for explaining an operation in case of collating two sheets of copies produced for respective manuscripts.
Figures 2, 12:
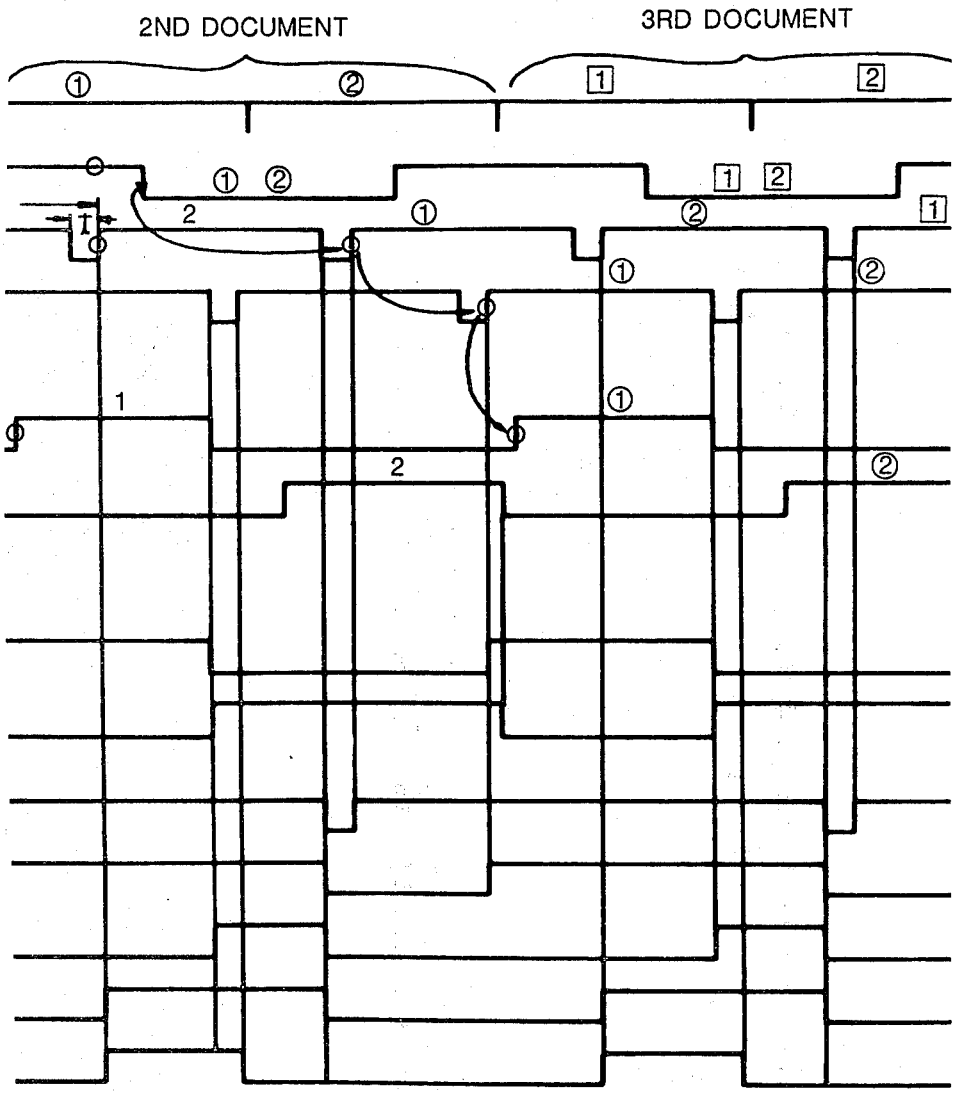
Figures 3, 12:
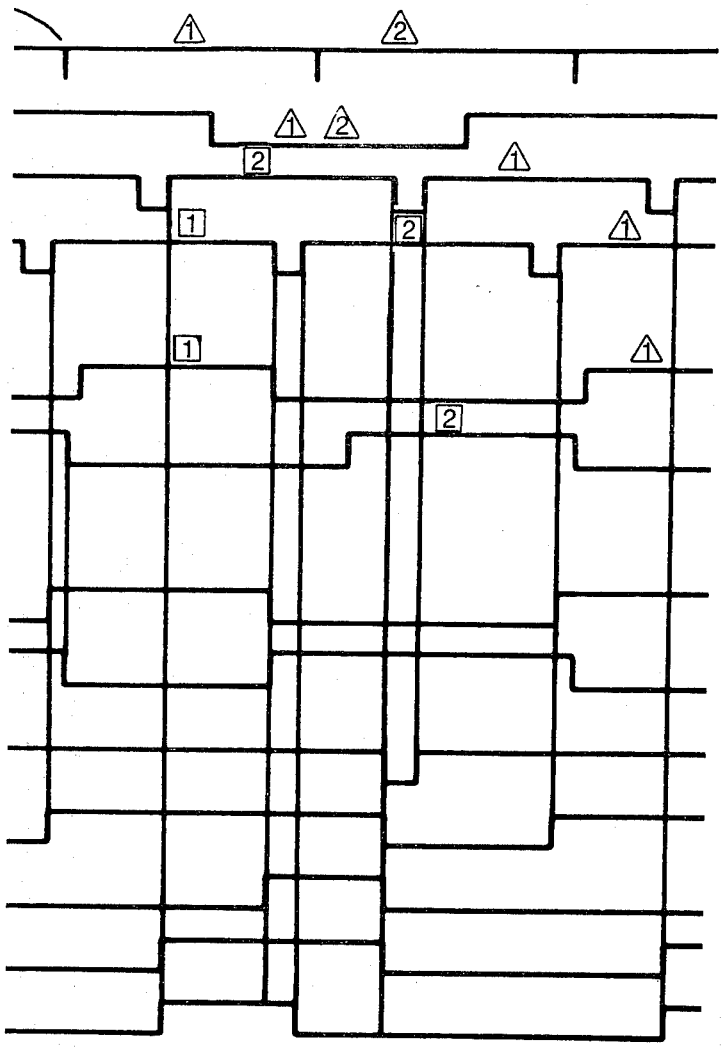

FIG. 12 is a diagram showing signal waveforms appearing in the respective steps in performing the collating action. In this embodiment, two copies formed for the respective documents are classified and supplied successively into the first bin 120-1 and the second bin 120-2. In FIG. 12A, the number of copies in the copying machine 40, and also the successive rotation timings of the photosensitive drum 51 are indicated. In FIG. 12B, the multiple copying signal (RET signal) supplied from the copying machine 40 is shown. This signal becomes L level during the duplication of the first copy of the respective manuscripts and becomes H level during the formation of the last copy thereof (in this embodiment, the second sheet is the last one). In FIG. 12C, the discharge timing of successive copies from the copying machine 40 is depicted. As mentioned above, the supplying cycle T is 6 seconds, and the successive copy time interval t is 0.67 sec. when using the longest copy papers. This time interval t is the same as that from the last copy of a manuscript to the first copy of a next one. Moreover, if use is made of shorter papers, a timing of the signal occurred at a front edge of a copy does not change, but a timing of the signal generated at a rear edge is only shortened and thus, the operation of the collator does not change significantly.

Before explaining the collating operation, the reset operation by means of the master reset signal supplied to the input terminal 486 upon switching the power supply on will be explained first with reference to FIG. 11. If the master reset signal MRS of H level is supplied to the input terminal 486, the counter 364 is cleared through OR gates 466, 455 and further counters 361, 362 are cleared through OR gate 423. As the signal of a H level supplied from OR gate 466 is applied to a clear terminal of FF 314 through NOR gate 447 and AND gate 448 as L level, this FF 314 is reset. In the same way, FF 312 is reset through NOR gate 442 and AND gate 439. Moreover, since this signal is supplied to a CK terminal of FF 311 through OR gate 419 and AND gate 420, and if the distributor 130 is not located at H.P, an output of the switch 300 becomes H level, output of AND gate 420 becomes H level and FF 311 is set, so that Q output of this FF becomes H level and is applied to one input of AND gate 463 through OR gate 460. As the signal having H level is always applied to AND gates 461–465 except at the emergency stop, a returning command signal for the distributor 130 is generated on the output terminal 496. In this way, when the distributor 130 returns to H.P, the output of switch 300 changes from H to L level, and an output pulse of H level is produced from the pulse circuit 327. Moreover, since this signal is supplied to a CL terminal of FF 311 through inverter 421, and FF 311 is reset, the returning command signal for the distributor becomes L level. In this manner, if, upon turning the power supply on, the distributor 130 is not located at H.P, the distributor is automatically returned to H.P. Besides, an output signal of OR gate 466 resets FFs 309; 308; 310; 305; 307; 301–304 through NOR gates 418; 417; 405; 403; 400 and 395, respectively. In this way, all FFs 301–314 are reset.

In the next place, the collate action as illustrated in FIG. 12 will be explained. In this case, when the collate switch 142 (in FIG. 6) is pushed, the collate state signal at input terminal 484 becomes H level and then this signal is supplied to one terminal of AND gate 451 through OR gate 450. Therefore, if the copying signal of L level is supplied to the other terminal of AND gate 451 through inverter 449, an output of AND gate 451 becomes H level and then this output signal is applied to the output terminal 498 through OR gate 452 and AND gate 465. In this way, the collator drive signal is generated at the output terminal 498.

In the middle of the copying action for the first manuscript the RET signal is supplied from the copying machine, and then this signal is supplied to AND gate 392 through the inverter 391. Since a pulse of H level is supplied to AND gate 392 when the paper discharge switch 75 detects a front edge of the copy, this pulse passes through AND gate 392 and FF 301 is set, so that Q output of this FF becomes H level. Therefore, $\overline{Q}$ output of FF 301 becomes L level, and then this output is applied to the output terminal 499 as the copying signal. Accordingly, this copying signal is the inverted signal of Q output of FF 301 as illustrated in FIG. 12I. Since Q output of FF 301 is supplied to AND gate 397, a pulse supplied from the pulse circuit 323 passes through AND gate 397 and sets FF 302 when the switch 102 located at the copy inlet of the collator detects a front edge of this copy, and an output pulse is provided from the pulse circuit 329 at a positive going edge of this Q output signal. This signal sets FF 306 through OR gate 398 and AND gate 399 and Q output thereof becomes H level. This Q output is applied to the output terminal 494 through OR gate 458 and AND gate 461 as the energizing signal of the deflection claw driving solenoid 124-1 for the first bin 120-1. Therefore, the first bin deflection claw 123-1 is rotated and the front end of this claw is intruded into the copy travelling path. In this way, immediately after the front edge of the first copy of the first manuscript is detected by the switch 102, the deflection device 121-1 of the first bin 120-1 is driven and the first copy is supplied into the first bin 120-1.

As shown in FIGS. 12C and 12D, after the front edge of the first copy is detected by the paper discharging switch 75 of the copying machine, the RET signal is changed to H level. Therefore, when the front edge of the second copy is detected by the paper discharging switch 75, a pulse generated from the pulse circuit 321 passes through AND gate 393 and sets FFs 304 and 305, so that their Q outputs become H level.

If the rear edge of the first copy of the first manuscript is detected by the switch 102 located at the inlet portion of the collator, a pulse of H level is generated from the pulse circuit 324 and FF 303 is set through AND gate 401 thereby. An output pulse is generated from the pulse circuit 330 in response to a front edge of this Q output and FF 307 is set through AND gate 402. Therefore, this Q output signal is applied to the output terminal 495 through OR gate 459 and AND gate 462 as the signal which energizes the solenoid 124-2 of the second deflection member 121-1. At the same time, since an output pulse of the pulse circuit 324 is applied to a CL terminal of FF 306 through NOR gate 400 as the pulse of L level, FF 306 is reset and there is no energizing signal of the first solenoid 124-1, so that the deflection claw 123-1 is removed out of the copy travelling path.

Subsequently, if a front edge of the second copy of the first manuscript is detected by the inlet switch 102, an output pulse is generated from the pulse circuit 323 and then this pulse passes through AND gate 406 and resets FF 305 through NOR gate 405. At the same time, the timer 351 is actuated. The function of this timer will be explained below. In this way, the second copy of the first document is supplied into the second bin 120-2.

When the rear edge of the second copy of the first manuscript is detected by the paper discharging switch 75, an output pulse is generated from the pulse circuit 322 and then this pulse passes through AND gate 394 and resets FFs 301, 302, 303, 304 through NOR gate 395. The states of these FFs are the same as the initial condition, but at this point there is no difference except that FF 307 is set and the second solenoid 124-2 is energized. If the rear edge of the second copy is detected by the switch 126-2 located at the second deflection device 121-2, this FF 307 is reset through NOR gate 403 by means of a pulse generated from the pulse circuit 325.

When the front edge of the first copy of the second manuscript is detected by the paper discharging switch 75, the collator operates in the same manner as that for the first copy of the first manuscript mentioned above and the first solenoid 124-1 is energized.

Figures 1, 13:
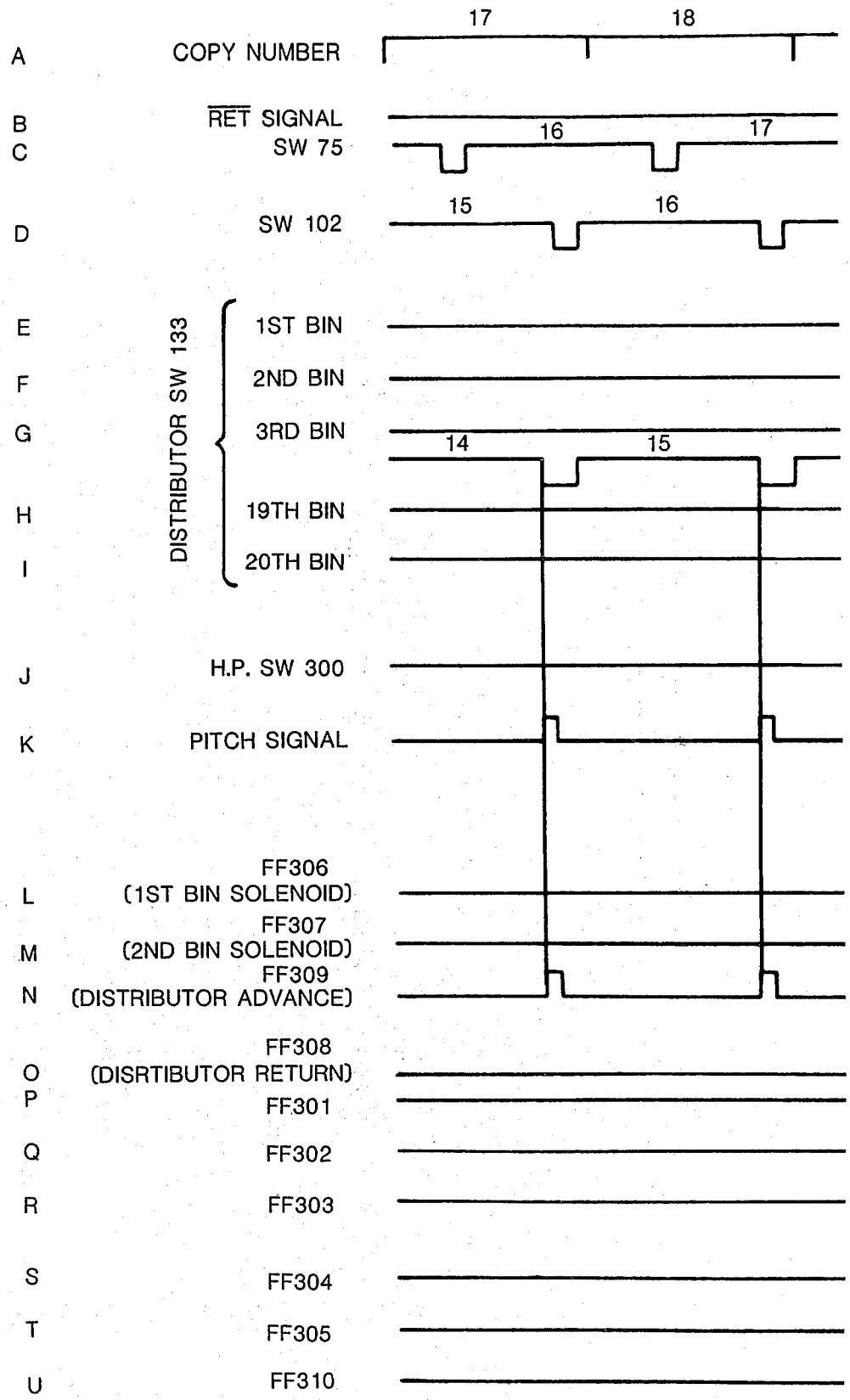
FIG. 13 is a diagram showing waveforms for representing an operation in case of collating 20 sheets of copies produced for the respective manuscripts.
Figures 2, 13:
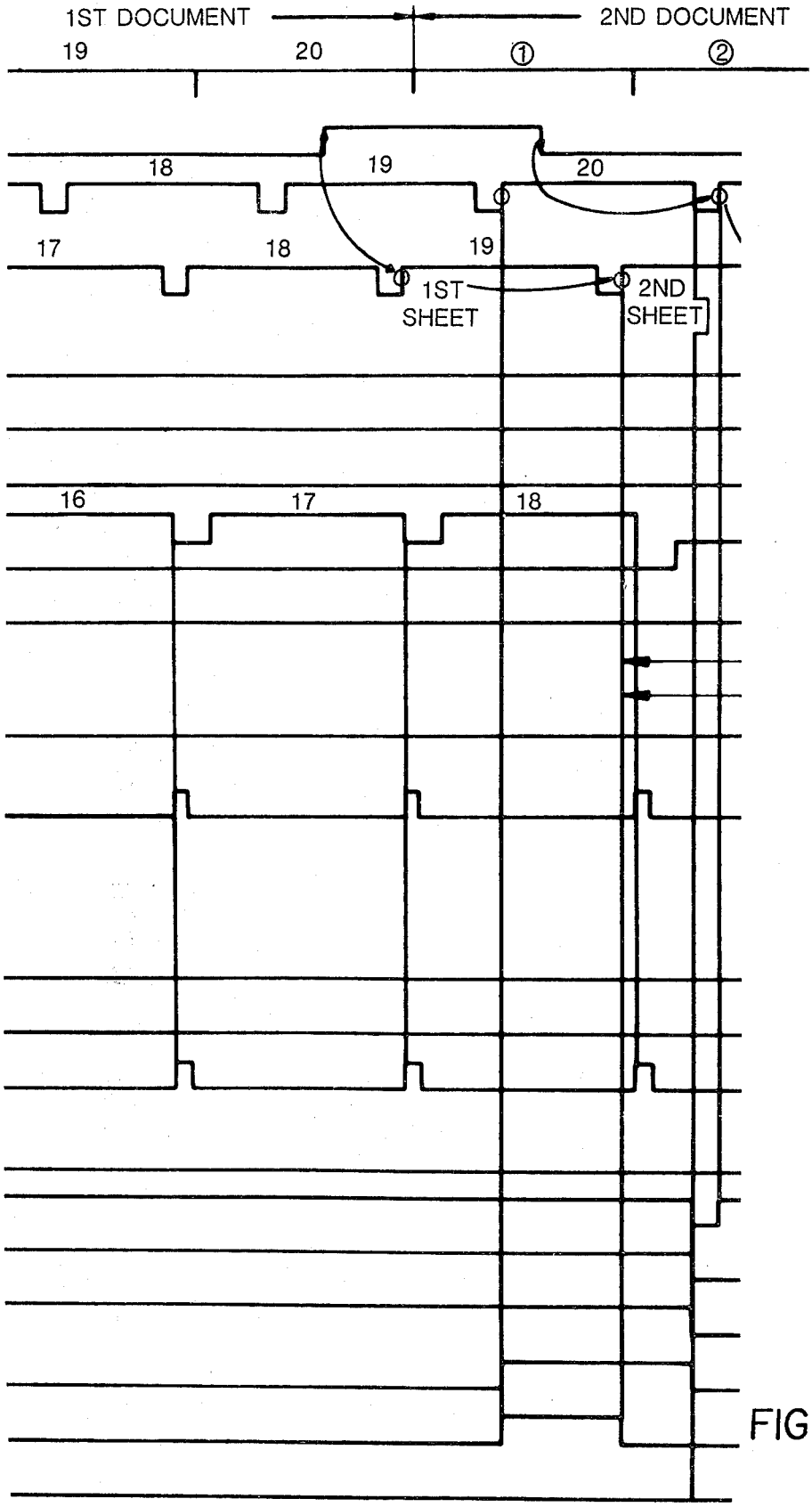
Figures 3, 13:
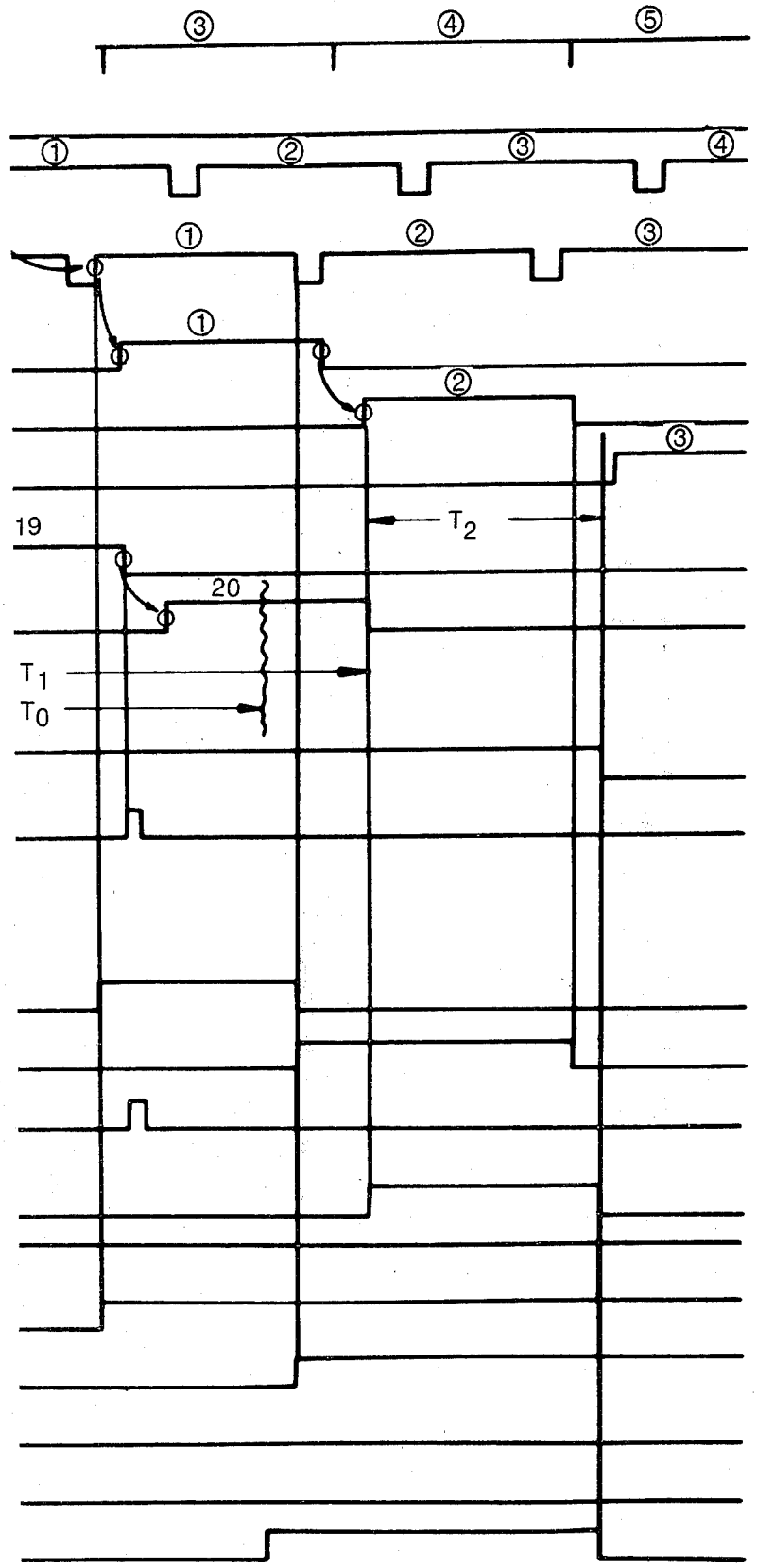

FIG. 13 is a diagram illustrating signal waveforms for explaining the operation of the collator in the case when twenty copies of the respective manuscripts are classified and supplied into the successive bins in the collate mode. Generally, the operation of the collator at transitions from the collating operation by the second deflection device 121-1 to that by the distributor 130 and from the distributor to the first deflection device 121-1 will be explained. As described above, the first and the second copies of the first manuscript are supplied into the first bin 120-1 and the second bin 120-2, respectively. However, in this case, the multiple copying signal (RET signal) continues at the L level, so that FFs 304, 305 are not set. Therefore, if a front edge of the second copy is detected by the switch 102 located at the inlet portion of the collator, a pulse of H level is not generated from AND gate 406, so that the timer 351 is not actuated. Moreover, FFs 301–303 continue to be set and also FF 304 continues to be reset. In such a state, a third copy of the first manuscript is deflected by the distributor 130 located at H.P and is supplied into the third bin 120-3. In this way, a signal having H level is generated from the distributor switch 133.

When the timer 351 is not actuated, an output pulse is produced from the pulse circuit 331 and FF 310 remains reset, so that Q output of this FF becomes H level and then this output is supplied to one input of AND gate 410. Since the collate mode signal of H level is applied to the other input of this AND gate 410, when the rear edge of the third copy is detected by the distributor switch 133, a pulse of H level is supplied from the pulse circuit 326. At this time, since the switch 299 located at the last bin does not detect the distributor, an L level signal is supplied to AND gate 416 through the inverter 415, and then an output pulse from the pulse circuit 326 passes through AND gate 416 and further through AND gate 410, so that FF 309 is set through OR gate 412. Therefore, Q output of this FF is applied to the output terminal 497 through AND gate 464. In this manner the distributor advance signal is applied to the distributor driving motor 136 (in FIG. 4). If the distributor moves by the distance of one bin pitch, the pitch signal is supplied to the input terminal 493. Therefore, an output pulse is generated from the pulse circuit 328 in response to a raising edge thereof, and this pulse resets FF 309 and stops the drive of the distributor. It follows then, that every time the successive copies are supplied into the successive bins 120-4, 120-5 . . . , the distributor 130 proceeds intermittently bin by bin.

As illustrated in FIG. 13, since the RET signal has ended and become H level by the time a front edge of the twentieth copy of the first manuscript is detected by the paper discharging switch 75 in the copying machine, FFs 304, 305 are set. Subsequently, when the front edge of the twentieth copy is detected by the switch 102 located at the inlet portion of the collator, the output pulse of H level is generated from AND gate 406 and the timer 351 starts to run. A time interval of this timer is $T_0$. At the same time, FF 305 is reset. At the end of the time interval $T_0$ of the timer 351, an output pulse is generated from the pulse circuit 331 and then FF 310 is set. Thus, $\overline{Q}$ output of this FF becomes L level and AND gate 410 is disabled. Therefore, even when the rear edge of the twentieth copy is detected by the distributor switch 133, FF 309 is not set and the distributor advance signal is not derived. At the end of the output pulse from the timer 351 an output pulse is generated from the pulse circuit 332 and FF 308 is set through AND gate 408. Q output of FF 308 is supplied to the output terminal 496 through AND gate 413, OR gate 460, and AND gate 463 as the distributor return signal, and then the distributor is returned to H.P. As described above, if the distributor arrives at H.P, FF 308 is reset and the distributor 130 stops at H.P.

As illustrated in FIGS. 13D and 13L clearly, if a front edge of the first copy for the second manuscript is detected by the inlet switch 102, FF 306 is set and the first solenoid 124-1 is energized, so that this copy is delivered into the first bin 120-1. Threfore, the twentieth copy of the first manuscript and the first copy of the second manuscript are treated or processed almost at the same time. After that the above mentioned action is repeated, and when the distributor 130 returns to H.P, FFs 308, 310 are reset through the pulse circuit 327 and the NOR gate 417. The collate operation can be performed by repeating the successive steps mentioned above for the successive manuscripts.

Figure 14A:
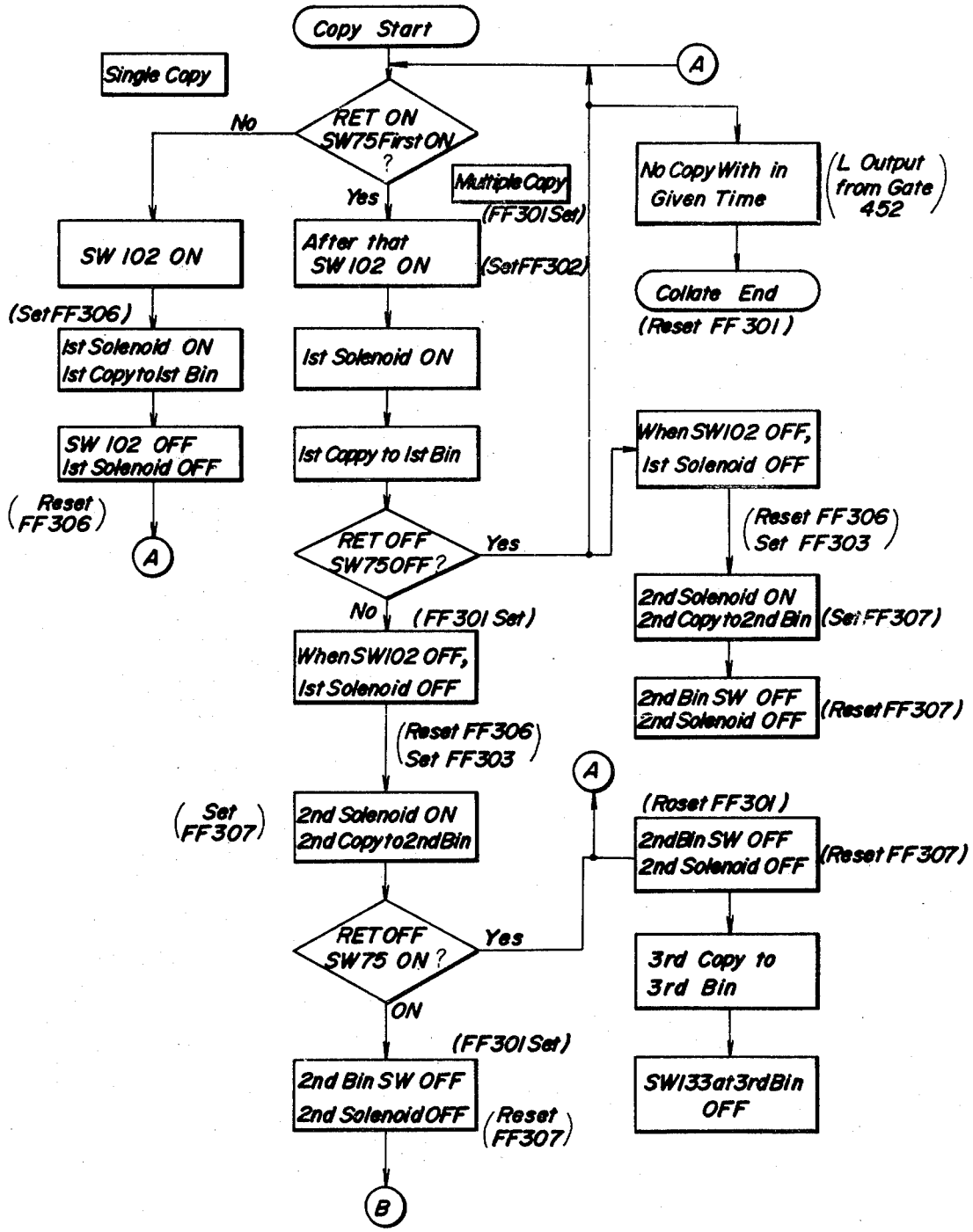
FIGS. 14A and 14B are diagrams showing a flow chart for depicting a collate action.

In the next place, the collate operation will be explained with reference to a flow chart illustrated in FIGS. 14A and 14B. If the RET signal is at L level at a time when the first copy after the start of the duplicating operation of the copying machine is detected by the paper discharging switch 75 in the copying machine, the number of the copies to be formed for respective documents is more than one. Contrary to this, if the RET signal is at H level, the number of copies to be formed for respective documents is one. In either case, the RET signal becomes H level during the duplication of the last copy among a predetermined number of copies, and after that, the paper discharging switch 75 is switched on by the last copy. Therefore, the copy by means of which the paper discharging switch 75 is switched on for the first time, after the RET signal has become H level, should not be delivered into the first bin 120-1. In consideration of the above mentioned matters, in case of single copying, the above copy is supplied into the first bin. When the RET signal becomes L level and the paper discharging switch is turned on, multiple copying has been selected. In this case, the solenoid 124-1 for the deflection claw of the first bin is energized by the signal supplied from the entrance switch 102, and the first copy is inserted into the first bin 120-1. Subsequently, it is ascertained, at a time when the paper discharging switch 75 is turned on, whether the RET signal is at L or H level. If the RET signal is at H level, the copying operation will be soon complete, but if the RET signal is still at L level, the copying operation will continue. As illustrated in FIG. 14A, if the RET signal is H level, the flow returns to a mark Ⓐ, and at the same time the second bin solenoid 124-2 is energized, so that the second copy is inserted into the second bin 120-2. If the RET signal is L level, the collate action proceeds to the next step, and the second bin solenoid 124-2 is energized, so that the second copy is inserted into the second bin 120-2. In the next place, the level of RET signal is checked again, and if the RET signal is H level, the third copy is inserted into the third bin 120-3 and the flow returns to a mark Ⓐ. If the RET signal continues to be L level, the flow proceeds to a mark Ⓑ. At the time when the third copy has been inserted into the third bin 120-3 and the distributor switch 133 is switched off, the distributor 130 moves by one pitch. Then, the fourth copy is inserted into the fourth bin 120-4. If it is detected that the RET signal has become H level and the paper discharging switch 75 is turned on, the flow returns to the mark Ⓐ and waits until the RET signal becomes L level (upon initiation of copying action for the next manuscript). Besides, if the RET signal continues to be L level, the distributor moves further by one pitch, and the preparation for inserting the fifth copy into the fifth bin 120-5 is performed. Consequently, the flow returns to the mark Ⓑ and this process is repeated until the RET signal becomes H level. In this way, by judging the level of RET signal upto the predetermined number n of copies (maximum 20 sheets), the distributor 130 is advanced by one pitch in succession, and the collating action is performed.

In this place, a problem occurs. After the RET signal has become H level and the paper discharging switch 75 has been turned on, the distributor 130 should be returned to H.P. The time relation between the RET signal, the paper discharging signal, and the output signal of the entrance switch 102 is fixedly determined for all copies. However, as illustrated in FIG. 13, the timings at which the distributor 130 is moved into the respective bin positions are successively delayed by a time corresponding to the bin distance according to the number of copies. The distributor 130 can be returned to H.P only after the last copy of a certain manuscript has been completely inserted into a given bin. For instance, when forming twenty copies for respective documents, the distributor can be returned to H.P only after the distributor switch 133, positioned at the twentieth bin, is switched off. But, at this time a first copy for a next manuscript has been already introduced into the collator. Therefore, in the collator according to the present embodiment, the return of the distributor to H.P can be effected in such a manner that the distributor can deliver a third copy of the next document into the third bin. In FIG. 13, the distributor 130 should be returned to H.P within a time interval $T_2$.

If the timing at which the distributor switch 133 is turned off at the twentieth bin is used as the timing for returning the distributor 130 to H.P, the distributor can be returned to H.P in time to correctly collate 4-19 copy sheets, and further the controlling process can be made simple. To this end, for instance, a timer may be provided. The timer may be actuated when the entrance switch 102 is turned on at the second time after the RET signal has changed into H level (that is, the last copy is detected by the switch 102), and the set time of the timer is so determined that its output will end at a time when the distributor switch 133 at the twentieth bin is turned off (as illustrated by $T_1$ in FIG. 13). Then, the distributor 130 may be returned by a time-up signal from the timer. However, for this application, the timer must be highly precise and is very expensive. For instance, if the set time $T_1$ is shorter, the distributor 130 starts to return even when the last copy is delivered into the twentieth bin, and if longer, the distributor 130 can not be returned to H.P in time for correctly collating the third copy of the next manuscript. Therefore, in the present embodiment, the timing for returning the distributor is so specified that the timer need not be of such high precision and can be made inexpensively. Also the distributor 130 can be returned to H.P surely.

That is to say, the starting point of the timer 351 is the same as that of $T_1$, i.e., the time when the inlet switch 102 is turned on by the last copy of the multiple sheets. From this point, the timer 351 is actuated to run and a time-up point of a set-time $T_0$ of the timer is set at a time in a time period during which the distributor switch 133, situated at the twentieth bin, is turned-on by the twentieth copy. If the distributor switch 133 is turned off before the time-up point of this set-time $T_0$, that is, the number of copies is smaller, the distributor 130 returns at this time. Contrary to this, if the distributor switch 133 is still turned on at the time-up point of the set-time $T_0$, the distributor 130 waits until the distributor switch is turned off and is returned to H.P at this later time. That is to say, if the last copy has been already supplied into the bin at the time-up point of the timer 351, the distributor 130 returns at this time-up timing, but if the last copy is still detected by the distributor switch 133 at the set-up point of the timer, the distributor 130 returns at the time when the distributor switch 133 is turned off, that is, when the copy has been just supplied into the bin. In the construction mentioned above, the times at which the return of the distributor 130 to H.P is initiated are different and are determined according to the present number of copies to be formed for respective documents.

In this way, the precision of the timer 351 can be roughly determined and an error within a time corresponding to one copy sheet is acceptable. Nevertheless, since the distributor 130 is returned at the time when the distributor switch 133 is turned off in case of many copies, the distributor 130 can return to H.P and a copy of the next manuscript can be collated in a correct manner.

Figure 14B:
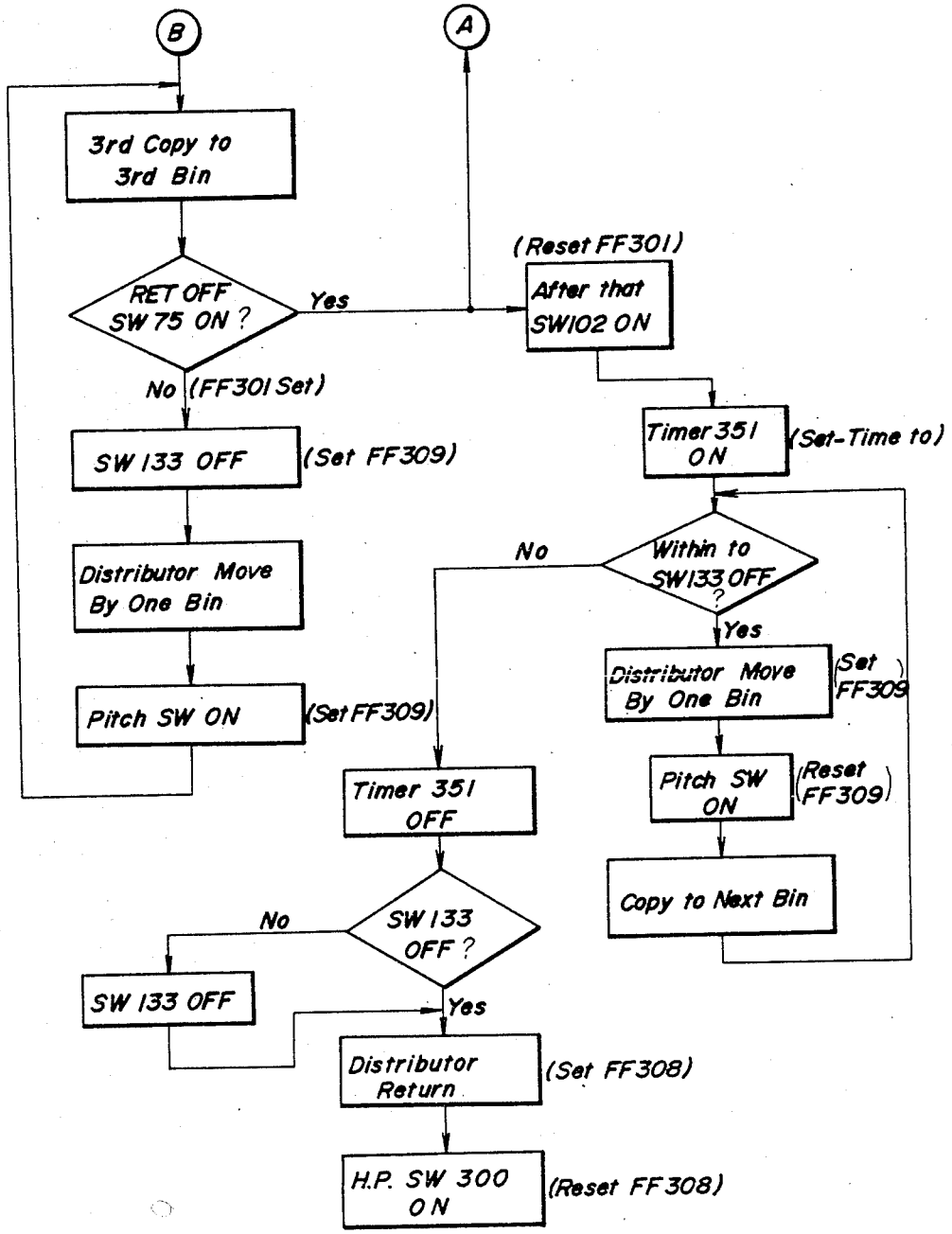

As illustrated in FIGS. 13 and 14B, after the RET signal has become H level and the paper discharging switch 75 has been turned on, the timer 351 is actuated at the time when the entrance switch 102 is turned on. At the same time, the flow returns to the mark Ⓐ and it is decided whether the copying action for the next manuscript is started or not. As described above, the starting point of the timer 351 is the time when the inlet portion switch 102 is turned on by the last copy. If the distribution switch 133 is turned off during the set time $T_0$ of timer 351 (2 times if the number of copies is 20), the distributor 130 is advanced to the next bin. If the distributor switch 133 is turned off at the set-up point of the set-time $T_0$ of the timer 351, the distributor 130 returns immediately. On the other hand, if the distributor switch 133 is still turned on at the time-up point of the timer 351, the distributor does not return until the distributor switch is turned off.

Now, the operation of the job mode will be explained.

When the job switch 143 is actuated, the job mode signal is supplied to the input terminal 485 from the output terminal 288 of the circuit shown in FIG. 9. This signal is supplied through OR gate 450, AND gate 451, OR gate 452, and AND gate 465 to the output terminal 498 as the collator driving signal. The job mode signal generates a clear signal for the counters 361–364 though OR gate 454, the pulse circuit 341, and OR gate 455. An output pulse from the pulse circuit 341 is supplied to a CK terminal of FF 311 through OR gates 457, 419, and AND gate 420 and sets this FF 311 so as to return the distributor 130 to H.P. If the distributor has already returned to H.P, the output pulse is not supplied to the CK terminal of FF 311.

Figures 1, 15:
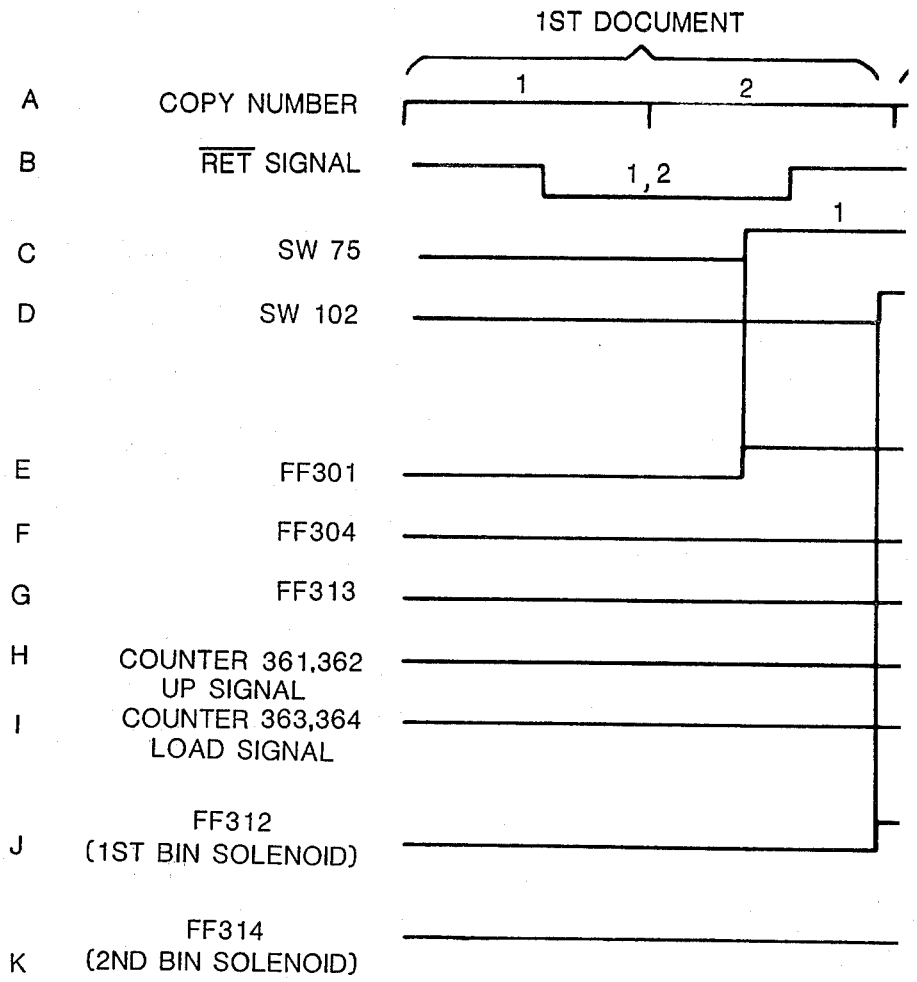
FIG. 15 is a diagram showing signal waveforms that explain an operation in case of processing two sheets of copies produced for respective manuscrips under a job mode.
Figures 2, 15:
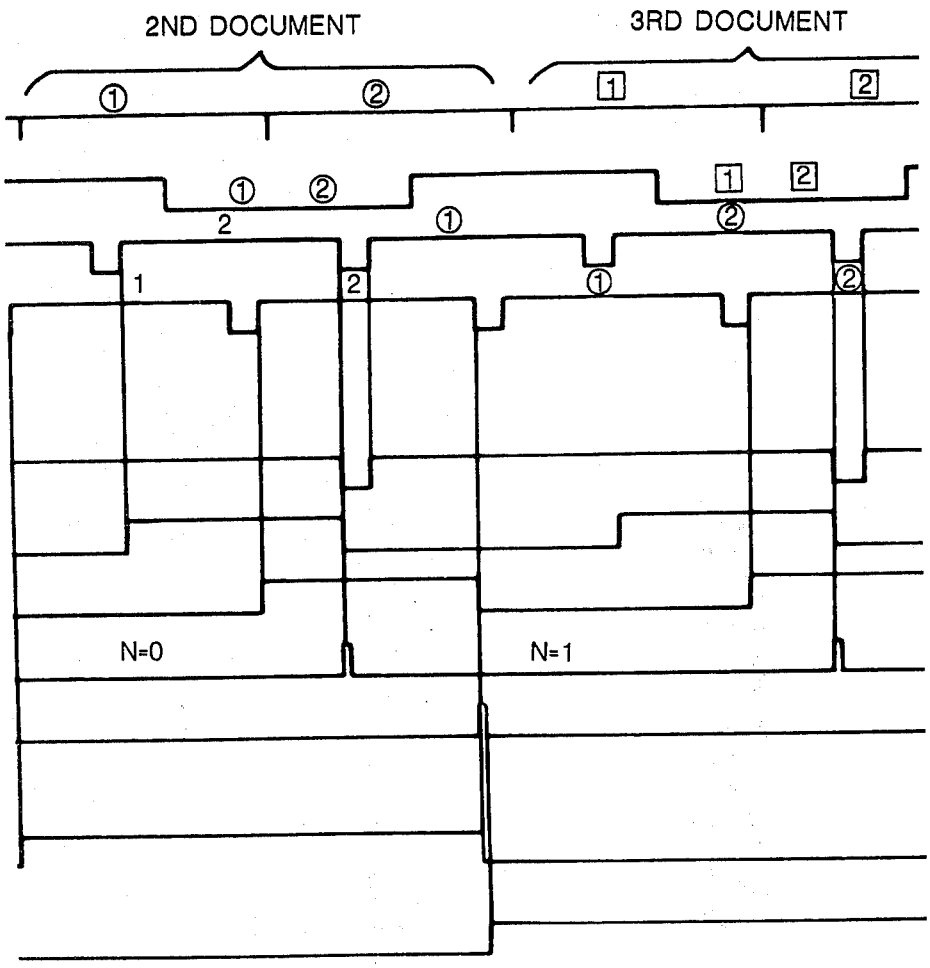
Figures 3, 15:
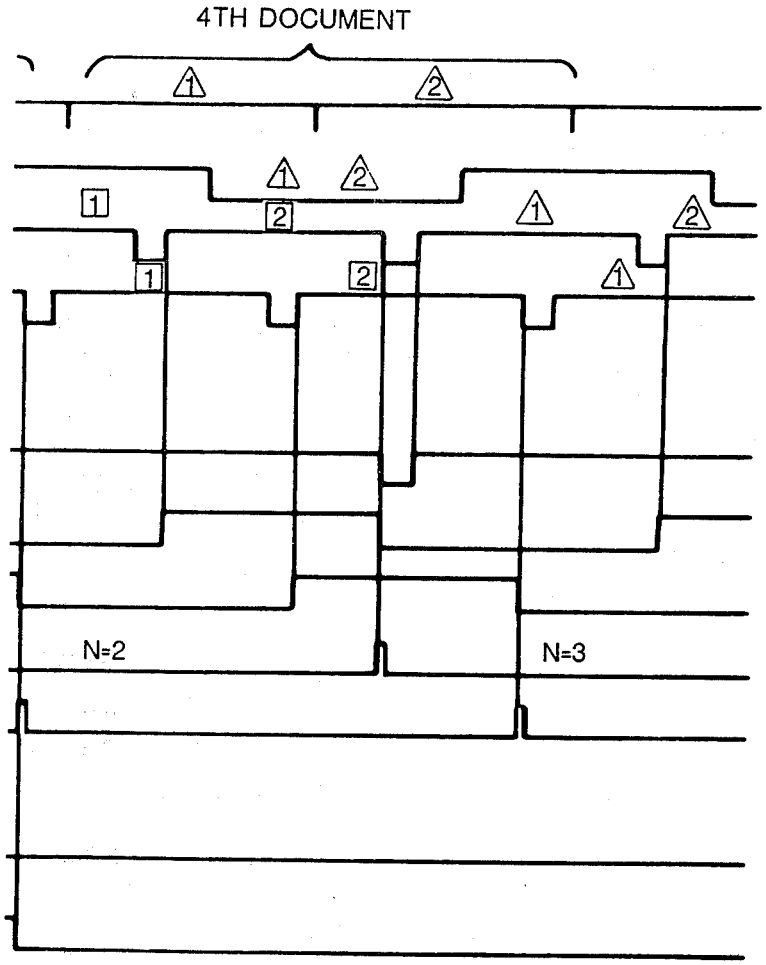

FIG. 15 shows waveforms at various portions in the circuit for the job operation in which two sheets of copies are produced for each of successive manuscripts and are delivered into each of successive bins. The operation when the first copy of the first manuscript is supplied is almost the same as the above mentioned collate action. If the front edge of the first copy is detected by the entrance switch 102, output of AND gate 437 becomes H level and FF 312 is set, so that the signal for energizing the first deflection claw driving solenoid 124-1 appears on the output terminal 494. The up-counters 361, 362 up-count the signal supplied from AND gate 422. This signal shown in FIG. 15H is obtained by making a logic product and AND gate 394 between Q output signal of FF 304 which is set at a timing when the front edge of the second copy for the first manuscript is detected by the paper discharging switch 75 after the RET signal has been finished and has become H level, and the signal which is applied from the pulse circuit 322 when the rear edge of this second copy is detected by the paper discharging switch. Therefore, by the outputs of the counters, an output of OR gate 424 becomes L level in collating the copy for the first manuscript (N=0), an output of OR gate 429 becomes L level in collating the copy for the second one (N=1), and an output of OR gate 430 becomes L level in collating the copy for the third one (N=2).

In this way, if the rear edge of the second copy for the first manuscript is detected after up-counters 361, 362 have counted one count, FF 312 is reset through AND gate 441, NOR gate 442, and AND gate 439, so that the first deflection claw is removed from the copy travelling path by de-energizing the first solenoid 124-1 and also FF 313 is reset as shown in FIG. 15G. At the same time, since an output of AND gate 441 passes through AND gate 445 and sets FF 314, the second solenoid 124-2 is energized and the second deflection claw 123-2 is introduced into the copy travelling path. In this way, two sheets of copies of the second manuscript are supplied into the second bin 120-2.

As mentioned above, if the rear edge of the second copy for the second manuscript is deflected by the paper discharging switch 75, from AND gate 394 the up-count signal is supplied to the counters 361, 362 through AND gate 422, and then an output of OR gate 430 becomes L level. After that, if the rear edge of the second copy is detected by the switch 102, an output of AND gate 441 resets FF 314 through NAND gate 446 and AND gate 448, and then the second deflection claw 123-2 is removed from the copy travelling path.

In the next place, since the outputs of OR gates 424 and 429 are held at H level when the first copy for the third manuscript is supplied, FF 312 and FF 314 are not reset, and the first and the second solenoids are not energized. Therefore, this copy for the third manuscript is supplied into the third bin 120-3 by the distributor 130 located at H.P.

When the output of AND gate 441 becomes H level, this signal is supplied to the counters 363, 364 as a load signal (see FIG. 15I). The circuitry defined by the timers 352, 353, the pulse circuits 333, 334, OR gates 434, 435 and AND gate 433 is a timer circuit, and, as illustrated in FIG. 16, if the rear edge of the last copy for respective manuscripts is detected by the switch 102, this timer circuit is activated and sets up a variable timer period defined by $$T_N = \frac{45 + (N - 1) \times 25}{V_1}$$

wherein N is the number of manuscripts, and $V_1$ is the copy travelling speed. That is to say, the counters 363, 364 are made down through OR gate 431 by the output pulses of H level generated from the pulse circuits 333 and 334 when the timers 352 and 353 are turned off, respectively. Since the number N of manuscripts is loaded to the counters 363, 364 by the output pulse of H level supplied from AND gate 441, the down signal is supplied through OR gate 431 by N times. The contents of counters 363, 364 become zero and a signal of L level appears at borrow terminal BW, so that AND gate 433 is disabled and the timer 353 is not set. Therefore, the output of OR gate 435 becomes L level and thus the timer interval $T_N$ is set to $$T_N = \frac{45 + (N - 1) \times 25}{V_1} \text{ sec.}$$

The trailing edge of the output pulse from the timer circuit is detected by the pulse circuit 335 to produce an output pulse which is supplied to FF 309 through AND gate 411 and OR gate 412, so that this FF is set and the distributor proceed signal appears on the output terminal 497. In this manner, the distributor 130 is advanced by one pitch. The same opertion mentioned above is repeated and then the copies of the successive manuscripts can be supplied into the successive bins under the job mode.

Figures 1, 16:
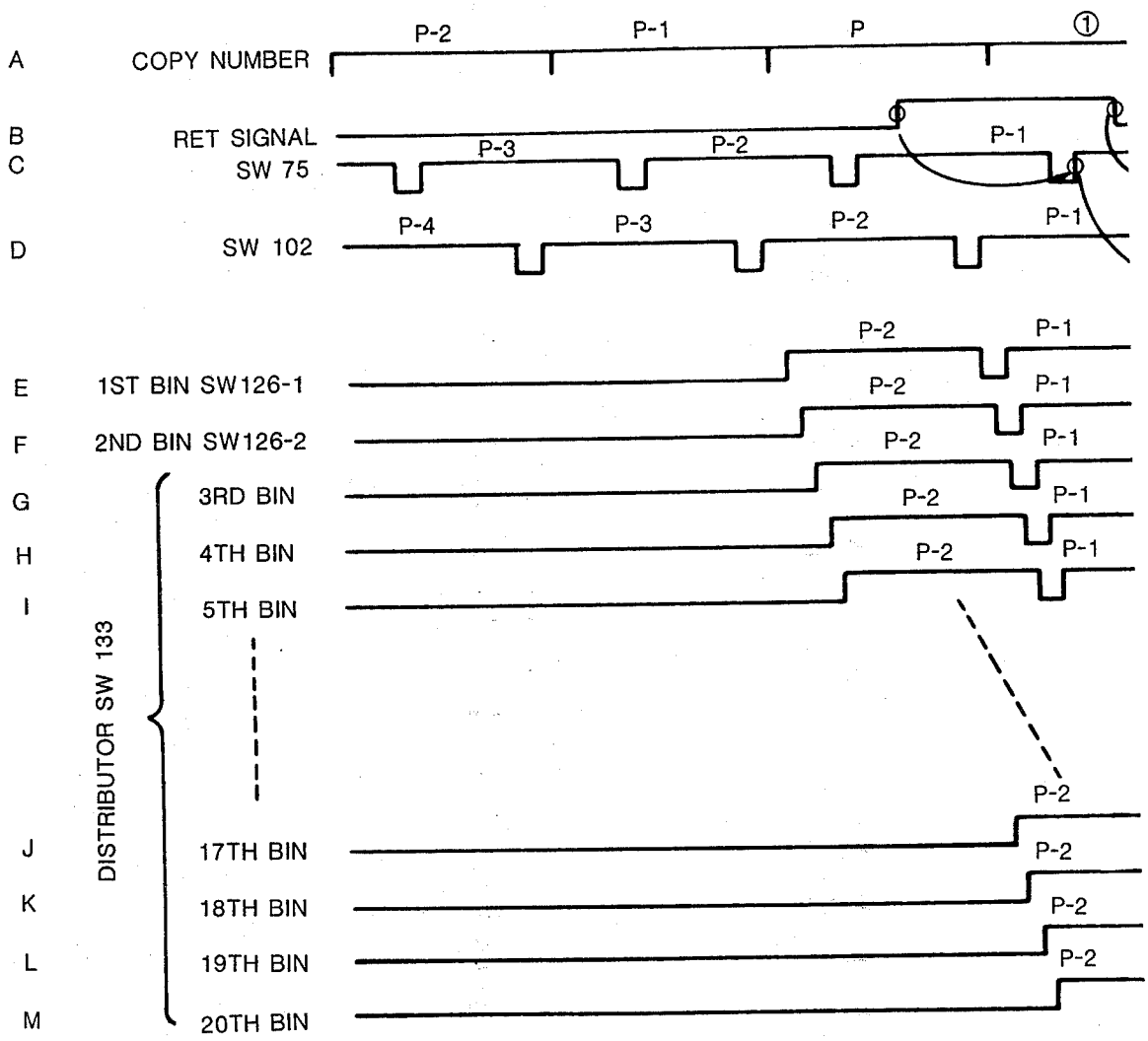
FIG. 16 is a diagram illustrating signal waveforms for explaining a distributor driving timing in case of the job operation.
Figures 2, 16:
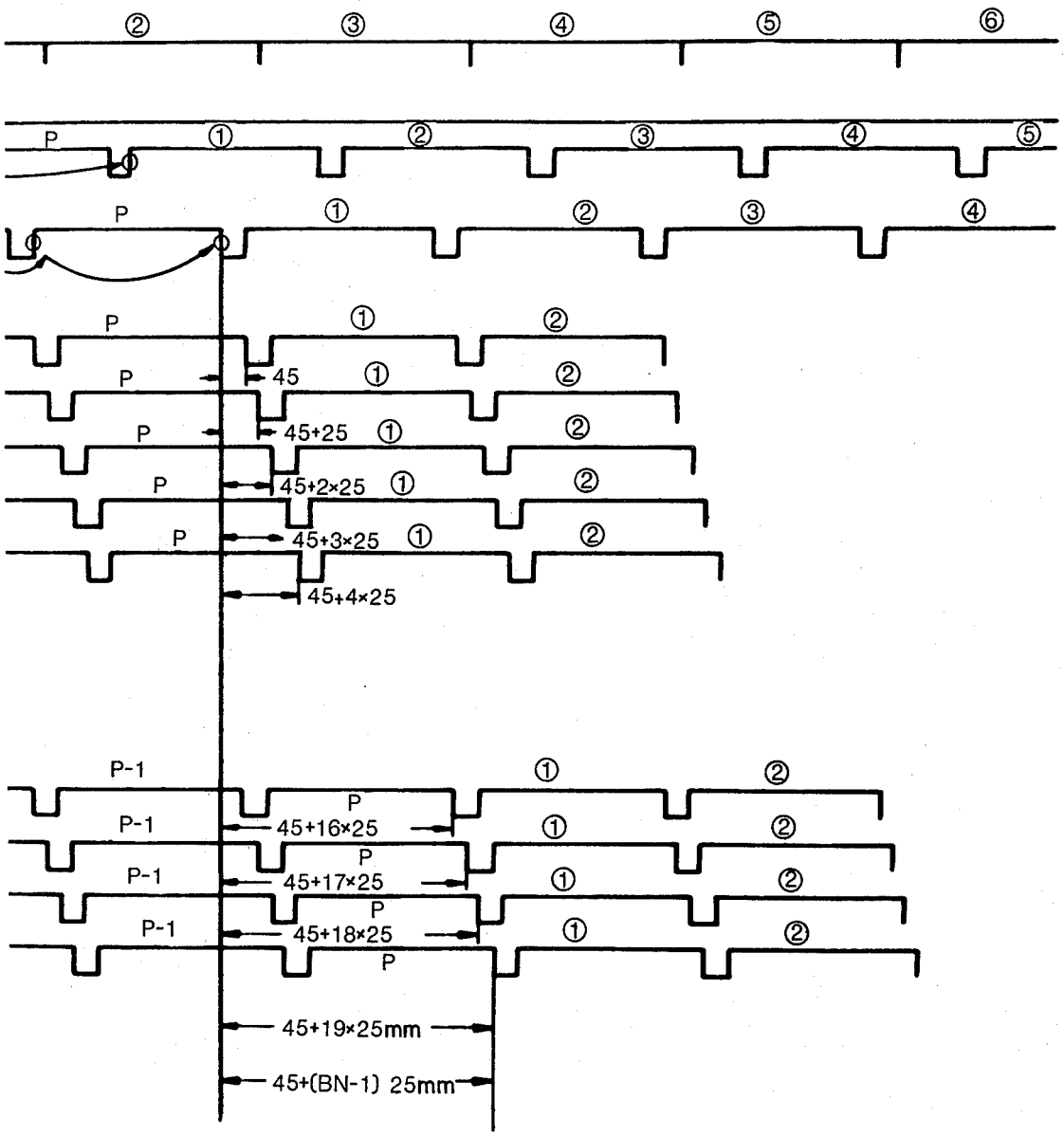

FIG. 16 is a diagram showing waveforms of various signals when processing p sheets of copies for respective manuscripts in the job mode, especially time lags for the distributor travelling times.

Figures 1, 17:
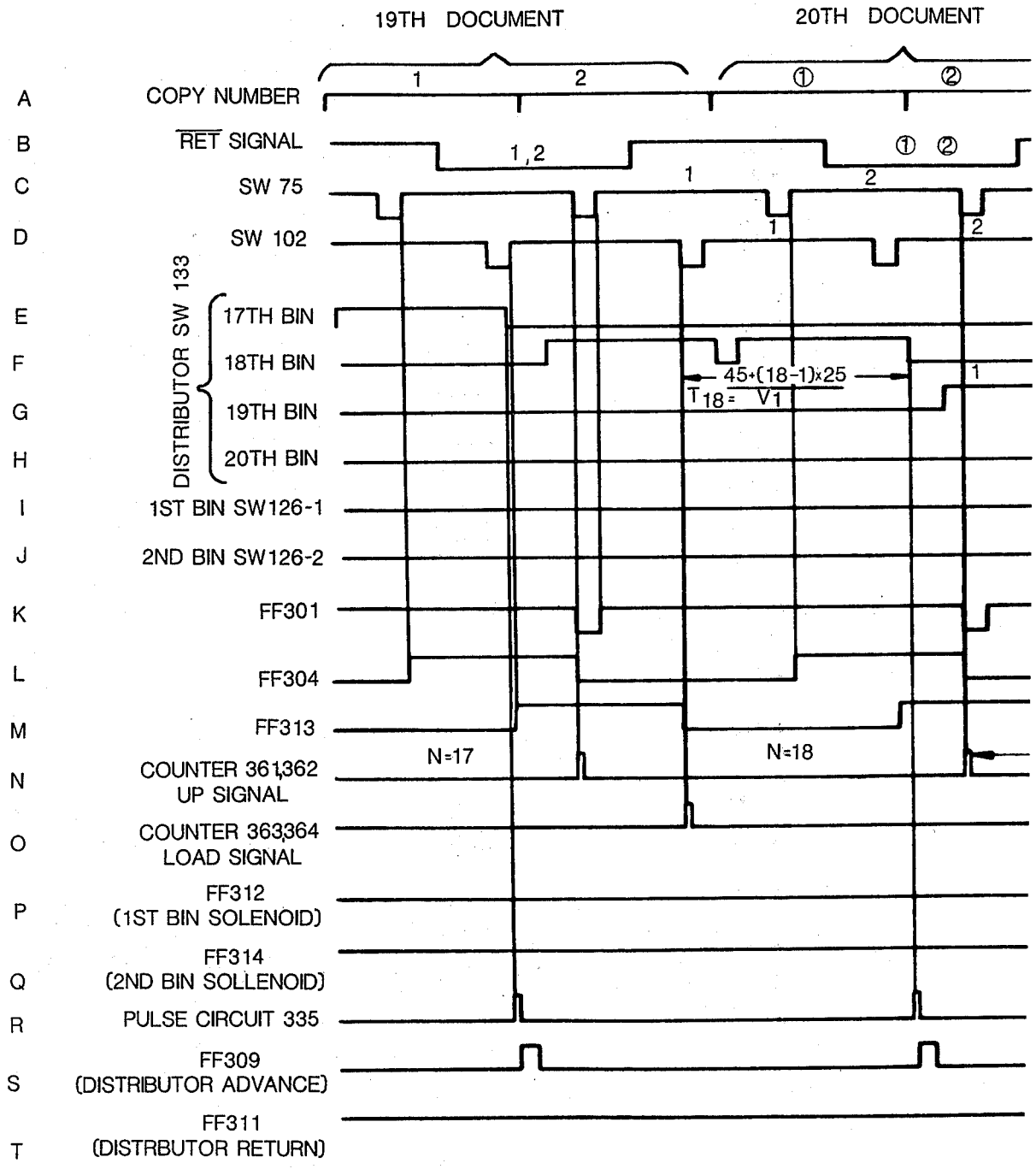
FIG. 17 is a diagram depicting signal waveforms for explaining an operation in case of processing two sheets of copies produced for more than twenty manuscripts under the job mode.
Figures 2, 17:
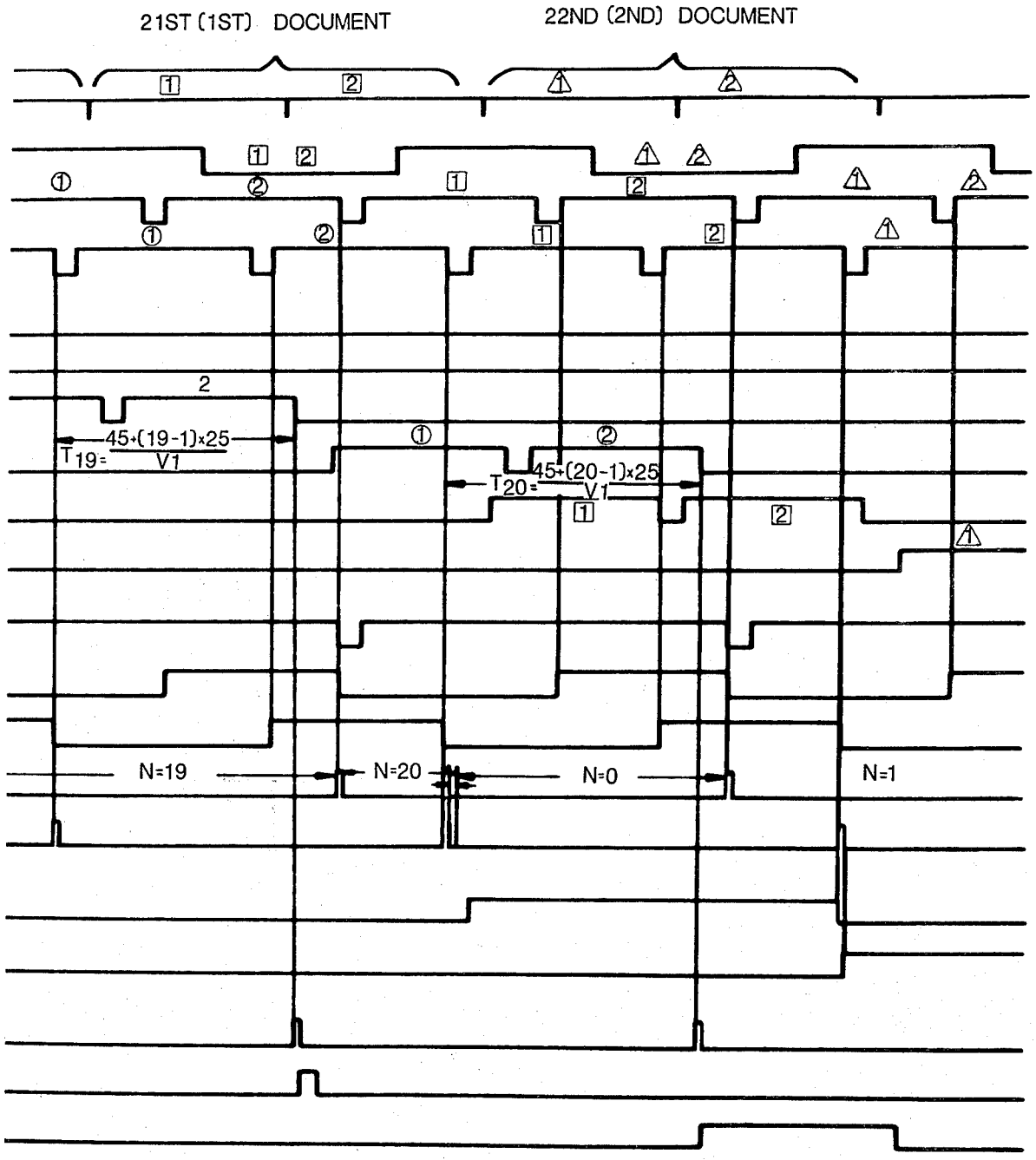

FIG. 17 is a diagram showing various waveforms when processing copies of more than twenty manuscripts under the job mode. For example, when the rear edge of the second copy for the nineteenth manuscript is detected by the entrance switch 102, the timer circuit sets the timer period of $$T_{19} = \frac{45 + (19 - 1) \times 25}{V_1} \text{ sec.,}$$

and at the end of this time period FF 309 is set by the output pulse supplied from the pulse circuit 335 (see FIG. 17R), so that the distributor advance signal is produced (see FIG. 17S). However, when the time period $T_{20}$ which starts when the rear edge of the second copy for the twentieth manuscript is detected by the switch 102 is finished, the distributor 130 is located at the twentieth bin 120-20 and the signal of L level is supplied to the input terminal 491 from the switch 299, so that FF 309 is not set, the FF 311 is set. Then the distributor return signal appears on the output terminal 496, and the distributor 130 returns to H.P. In this way, the copies for the next twenty first manuscript are delivered into the first bin 120-1 in the same way as the copies for the first manuscript. Since AND gate 456 has been enabled by the signal from the switch 299, which detects that the distributor 130 is located at the position of twentieth bin, an output pulse from the pulse circuit 335 passes through OR gate 455 and makes the counters 361, 362 clear.

Figure 18:
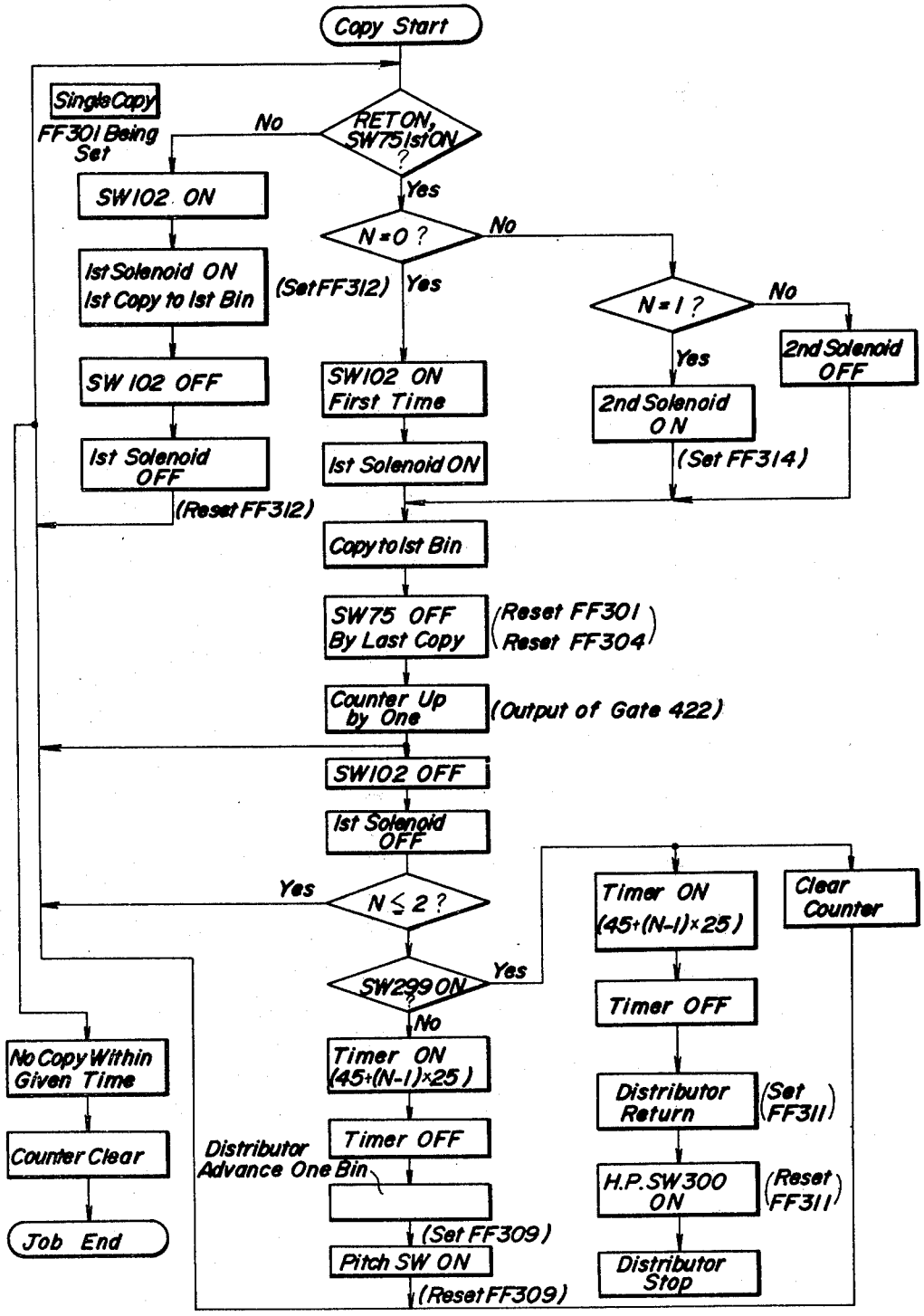
FIG. 18 is a diagram showing a flow chart of the job operation.

FIG. 18 is a diagram showing a flow chart of the job operation mentioned above. If the copying action of the copying machine is initiated, but the RET signal remains at H level (that is, in processing a first copy), the entrance switch 102 is turned on, and the copy is inserted into the first bin 120-1 by energizing the first bin deflection claw solenoid 124-1. When the switch 102 is turned off, the first bin deflection claw solenoid 124-1 is de-energized. That is, after the RET signal has become L level, when the paper discharging switch 75 is turned on, the first bin deflection claw solenoid 124-1 is energized, provided the up-counters 361, 362 are zero, and then the copies for this manuscript are delivered into the first bin 120-1. At the time when the last copy for the first manuscript passes through the paper discharging switch 75, one up-count is effected in the up-counters 361, 362. At this time if the next copying action is initiated, the flow returns to the initial condition.

When the switch 102 is turned off, the first soelnoid is de-energized, and if the content N of counters 361, 362 is equal to or smaller than 2, the job operation returns to the initial state. If N>3, the job operation proceeds to the next step. At N=1, when the next copying action is initiated, the RET signal changes to L level, and the paper discharging switch 75 is turned on, the second bin deflection claw solenoid 124-2 is energized and the copies for the second manuscript are inserted into the second bin 120-2, because the content of the counters 361, 362 is 1. If the last copy for the second manuscript passes through the paper discharging switch 75, the counters 361, 362 proceed by one count (become N=2). When the copying action for the next manuscript is started, the flow returns to the start condition. When the switch 102 is turned off, the second bin deflection claw solenoid 124-2 is de-energized. Subsequently, the copying action starts and then, as N=2, the copies for the third manuscript are supplied into the third bin 120-3. After the last copy for the third manuscript has passed through the paper discharging switch 75, the counters 361, 362 proceed by one count, so that N=3. When the last copy passes through the switch 102, the content of the counters becomes N=3, so that the job operation proceeds to the following process, namely, whether the switch 299, which detects that the distributor is located at the position of the twentieth bin, is to be turned on or not. At this time, since the distributor 130 is located at the third bin 120-3, the timer circuit starts to run. As this timer circuit has the timer period $T_N$ sec. defined by $$\frac{45 + (N - 1) \times 25}{V_1}$$

(the distance between the switch 102 and the switch 126-1 of the first bin is 45 mm and the bin space is ≅mm). In this case the counter content is N=3, the timer produces the output signal having a duration of $$\frac{45 + (3 - 1) \times 25}{V_1} \text{ sec.}$$

At the trailing edge of the timer output signal, the distributor 130 is advanced to the next bin. When the distributor moves by one bin, the pitch signal of H level appears and then the distributor stops at the next bin. In a similar manner when the next duplicating operation is started, the flow returns to the initializing state and the copies for a fourth manuscript are delivered into the next bin, i.e. the fourth bin.

The same action just described is repeated until the nineteenth manuscript. If the last copy for this manuscript passes through the paper discharging swich 75, the content of counters 361, 362 is N=20, so that the switch 102 is turned off and then the timer period $$T_{20} = \frac{45 + (20 - 1) \times 25}{V_1} \text{ sec.}$$

is set. When this time period has elapsed, the distributor 130 does not advance, but is returned to H.P. This return of the distributor is stopped when the home position detecting switch 300 is turned on. If the copying action for the next document has started, the flow returns to the initializing state and then the job operation continues from the first bin. During this job operation, if a new copying action for the next manuscript has not started, the counters 361, 362 are reset after a certain blanking time and the job operation is finished.

In the above explanation, the job operation is performed for the two sheets of copies for the respective manuscripts, but of course in case of forming only one copy for the respective documents, copies can be treated in the job mode. In this case, since the multiple copying signal (RET signal) is not generated from the copying machine, the counter may count the count down signal supplied from the copying machine.

In the circuit described in FIG. 11, when the emergency stop signal is supplied to the input terminal 487, all the output signals are inhibited by disabling AND gates 461–465 and also the circuit is reset to the initial condition through the inverter 467 and OR gate 466. Moreover, when the job mode signal or the collate mode signal is reserved and then executed during the copying operation, the timers 355, 356 maintain the executed mode only during their timer periods.

Figure 19:
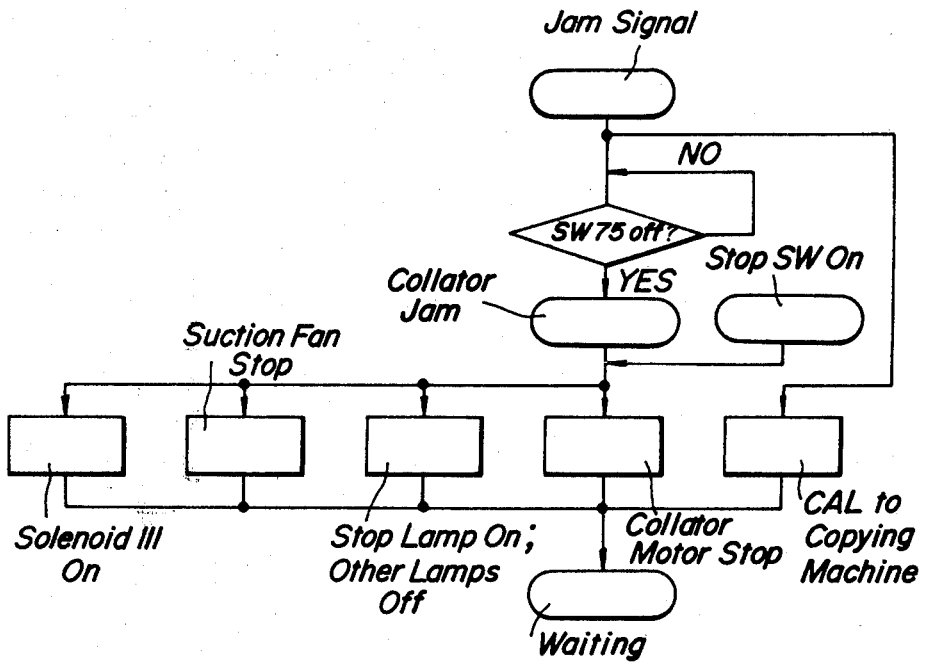
FIG. 19 is a diagram showing a flow chart that explains an operation upon paper jam.

FIG. 19 is a diagram showing a flow chart when a paper jam or clog has occurred in the collator. The copy jam in the collator iis detected by means of various known techniques and the jam signal is generated. At this time, the collate mode is stopped, a collator alarm signal (CAL signal) is sent to the copying machine, and the copy count number is cleared. After that, a few sheets of copies may be further discharged from the outlet of the copying machine. In order to supply these copies into the extra tray 109, the solenoid 111 is energized. It is necessary to supply smoothly the copies into the extra tray. If the copy travelling path is changed while a copy is discharged from the outlet of the copying machine, the paper jam might occur since the paper stops there and remains in the copying machine side. In some cases the copy paper might be burnt in the heater arranged near the outlet of copying machine. Therefore, if the timing for changing the copy travelling path is to be the timing when there are no copies at the outlet of this copying machine, the above mentioned defect does not occur. That is to say, if the collator jam is occurs while the copy is discharged and thus, the paper discharging switch 75 is on, the change of copy path into the extra tray 109 may be effected after the paper discharging switch 75 is turned off and then the collator may be stopped. In explaining the flow chart illustrated in FIG. 19, after the collator jam signal has occurred, the collator alarm signal (CAL) is sent to the copying machine and if, at this time, the paper discharging switch 75 is turned on, the collator is set to the collator jam mode after the switch 75 has been turned off. In the collator jam mode, a driving motor of the collator and the suction fan 107 are de-energized. The solenoid 111 is energized to change the travelling path into the extra tray 109 and the emergency stop lamp 148 is switched on, but the remaining lamps are all switched off.

The invention is not limited to the above described embodiments, but various modifications and alternations are possible within the scope of the invention. In the embodiment mentioned above, the collater is presented as a hybrid type in which copies are delivered into the two upper most bins by the deflection devices and are supplied into the remaining bins by moving the distributor, but the invention is not limited to this example, and any other type of collator such as a distributor moving type, a deflection type, a bin moving type and so on may also be adopted. Moreover, the controlling circuits may be formed in various manners other than those illustrated in the drawings.

What is claimed is:

1. A collator for use in combination with a copy discharge apparatus such as a copying machine, a printing machine and the like which discharges a plurality of copies of originals in succession, said collator comprising:

a series of bins arranged in parallel with each other at a constant pitch;

feeding means for feeding the copies through a copy feed path along the series of bins at a constant speed, a distributor operative to move along said copy feed path across a predetermined number of bins to deliver the copies into said predetermined number of bins;

first setting means in response to actuation of an operation for setting the collator in a collate mode in which a plurality of copies of respective orginals are delivered into successive bins;

second setting means in response to actuation of the operator for setting the collator in a job separation mode in which all copies of each of successive originals are delivered into respective bins in succession, and time pulse generating means for generating a timing signal for moving said distributor in said job separation mode, said time pulse generating means including counting means for accumulating a signal supplied from said copy discharging apparatus to produce a count value N, said signal representing the number of said originals, means arranged at an inlet portion of the collator for detecting a rear edge of the respective copies to produce a copy detection signal, variable timer means for settiing, in response to the copy detection signal supplied from said copy detecting means upon detection of the rear edge of the last copy of an Nth original, a set time represented by $b+(N-1)xa/V_1$, wherein a is said constant pitch of the series of bins, b is a distance from said copy detecting means to the first bin viewed in a copy feed direction and $V_1$ is said constant copy feeding speed, said timing signal which defines the timing for advancing the distributor bin by bin being produced at a completion of said set time.

2. A collator according to claim 1, wherein said signal to be counted by said counting means is a multiple copy signal which is generated while said apparatus supplies a predetermined number of copies of an original.

3. A collator according to claim 1, wherein said signal to be counted by said counting means is a countdown signal which is generated when the predetermined number of copies of an original have been made.

4. A collator according to any one of claims 1, 2 and 3, wherein said distributor is movable except for at least one upstream bin viewed in a collating direction and at least one deflector provided at said at least one upstream bin.

5. A collator according to claim 1, wherein the collator further comprising means for returning the distributor to a home-position, when said job separation mode has been finished.

6. A collator according to claim 1, wherein said counting means is cleared when a predetermined time has elapsed after the last copy of an original has been made by said apparatus.

* * * * *